US007135265B2

(12) United States Patent
Teshima

(10) Patent No.: US 7,135,265 B2
(45) **Date of Patent: *Nov. 14, 2006**

(54) PRODUCTION METHOD OF TONER, TONER, AND TONER PRODUCING APPARATUS

(75) Inventor: Takashi Teshima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 270 days.

This patent is subject to a terminal disclaimer.

(21) Appl. No.: 10/457,020

(22) Filed: Jun. 9, 2003

(65) Prior Publication Data

US 2004/0048183 A1 Mar. 11, 2004

(30) Foreign Application Priority Data

Jun. 10, 2002 (JP) ..... P.2002-169348
Jun. 10, 2002 (JP) ..... P.2002-169349

(51) Int. Cl.
*G03G 9/08* (2006.01)

(52) U.S. Cl. ..... 430/137.1; 430/137.14; 430/137.17; 430/110.3

(58) Field of Classification Search ..... 430/137.1, 430/137.14, 137.17, 137.19, 110.3
See application file for complete search history.

(56) References Cited

U.S. PATENT DOCUMENTS 3,965,021 A 6/1976 Clemens et al.
3,967,962 A 7/1976 O'malley
4,671,906 A 6/1987 Yasue et al.
4,940,644 A 7/1990 Matsubara et al.
5,147,747 A 9/1992 Wilson et al.
5,240,803 A 8/1993 Ota
6,083,454 A 7/2000 Tang et al.
6,235,444 B1 5/2001 Nagai et al.
6,852,463 B1 * 2/2005 Teshima ..... 430/110.3

FOREIGN PATENT DOCUMENTS

DE 40 20 303 A1 1/1992

OTHER PUBLICATIONS

Patent Abstracts of Japan (1981), vol. 0050, No. 52 European Search Report dated Jul. 12, 2004.

* cited by examiner

*Primary Examiner*—Janis L. Dote
(74) *Attorney, Agent, or Firm*—Sughrue Mion, PLLC

(57) ABSTRACT

The present invention provides a method for producing a toner, which produces a toner by using a dispersion comprising a dispersion medium having finely dispersed therein a dispersoid containing a raw material for the production of a toner, the method comprising intermittently ejecting the dispersion from a head unit by applying an ejection energy, and solidifying it into a particulate form while transporting the ejected dispersion through a solidification unit by an air flow. The ejection energy may be applied in the form of pressure pulse, or may be applied by the volume change of a bubble. Also disclosed are a toner obtained by the method, and an apparatus for performing the method.

47 Claims, 8 Drawing Sheets

PRODUCTION METHOD OF TONER, TONER, AND TONER PRODUCING APPARATUS

FIELD OF THE INVENTION

The present invention relates to a method for producing a toner, a toner, and an apparatus for producing a toner.

BACKGROUND OF THE INVENTION

A large number of electrophotographic methods are known and the electrophotographic method generally comprises a step of forming an electrical latent image on a photoreceptor by various means utilizing a photoconductive substance (exposure step), a development step of developing the latent image using a toner, a transfer step of transferring the toner image on a transferee material such as paper, and a step of fixing the toner image under heating, pressure or the like using a fixing roller.

The toner for use in such an electrophotographic method is produced by a pulverizing method, a polymerization method or a spray dry method.

The pulverizing method is a method of kneading a raw material containing a resin as a main component (hereinafter sometimes simply referred to as a "resin") and a coloring agent at a temperature higher than the softening point of resin to obtain a kneaded material and then cooling and pulverizing the kneaded material. This pulverizing method is advantageous in that the raw material can be selected over a wide range and a toner can be relatively easily produced. However, the toner obtained by the pulverizing method varies widely in the shape among particles and the particle size distribution is disadvantageously liable to be broad. As a result, the electrical charging property, fixing property and the like vary widely among toner particles and the toner as a whole decreases in the reliability.

The polymerization method is a method of performing a polymerization reaction using a monomer as a constituent component of a resin in a liquid phase or the like to produce the objective resin and thereby produce a toner particle. This polymerization method is advantageous in that the toner particle obtained can have a shape relatively high in the sphericity (a shape close to a geometrically complete sphere). However, in the polymerization method, the fluctuation in the particle size among particles cannot be sufficiently reduced in some cases. Furthermore, in the polymerization method, the latitude in the selection of a resin material is narrow and a toner having objective properties is sometimes not obtained.

The spray dry method is a method where a raw material for the production of a toner, which is dissolved in a solvent, is sprayed using a high-pressure gas and thereby, a fine powder is obtained as a toner. The spray dry method is advantageous in that the above-described pulverizing step is not necessary. However, in this spray dry method, the raw material is sprayed using a high-pressure gas and therefore, the spraying conditions of the raw material cannot be precisely controlled, as a result, a toner particle having objective shape and size is difficult to produce with good efficiency. Furthermore, in the spray dry method, the particle size varies widely among particles formed by spraying and therefore, the moving speed also varies widely among particles. This causes collision or aggregation of sprayed particles before the sprayed raw material is solidified, and a powder of anomaly shapes is formed, as a result, the fluctuation in the shape and size sometimes more increases among finally obtained toner particles. As such, the toner obtained by the spray dry method varies widely in the shape and size among particles, therefore, the electrical charging property, fixing property and the like also vary widely among toner particles and the toner as a whole decreases in the reliability.

SUMMARY OF THE INVENTION

An object of the present invention is to provide a toner having a uniform shape and a narrow particle size distribution.

Another object of the present invention is to provide a method and an apparatus for producing a toner, by which a toner as described above can be produced.

Other objects and effects of the invention will become apparent from the following description.

The above-described objects of the present invention have been achieved by providing the following items (1) to (70).

(1) A method for producing a toner, which produces a toner by using a dispersion comprising a dispersion medium having finely dispersed therein a dispersoid containing a raw material for the production of a toner, said method comprising intermittently ejecting said dispersion from a head unit by applying an ejection energy and solidifying it into a particulate form while transporting the ejected dispersion through a solidification unit by an air flow.

(2) The method for producing a toner according to item (1) above, wherein said ejection energy is applied in the form of pressure pulse.

(3) The method of producing a toner according to item (1) above, wherein said ejection energy is applied by a volume change of a bubble.

(4) The method for producing a toner according to item (3) above, wherein said volume change of a bubble mainly accompanies a liquid/gas phase transition of said dispersion medium.

(5) The method for producing a toner according to any one of items (1) to (3) above, wherein said dispersoid in said dispersion ejected from said head unit is aggregated during the passing through the solidification unit.

(6) The method for producing a toner according to any one of items (1) to (3) above, wherein said dispersoid is a liquid.

(7) The method for producing a toner according to any one of items (1) to (3) above, wherein said dispersion medium mainly comprises water and/or a liquid having excellent compatibility with water.

(8) The method for producing a toner according to any one of items (1) to (3) above, wherein said dispersion contains an emulsifying dispersant.

(9) The method for producing a toner according to any one of items (1) to (3) above, wherein said dispersion is an O/W emulsion.

(10) The method for producing a toner according to any one of items (1) to (3) above, wherein said dispersion is prepared by charging a material containing a resin or a precursor thereof into a liquid containing at least water.

(11) The method for producing a toner according to item (10) above, said material to be charged is in the state of at least a part thereof being softened or melted.

(12) The method for producing a toner according to item (10) above, wherein said material is in the powder or particulate form.

(13) The method for producing a toner according to any one of items (1) to (3) above, wherein said dispersion is prepared through a mixing step of mixing a resin solution containing at least a resin or a precursor thereof and a solvent capable of dissolving at least a part of said resin or precursor with an aqueous solution containing at least water.

(14) The method for producing a toner according to item (13) above, wherein said mixing step is carried out by adding dropwise a liquid droplet of said resin solution to said aqueous solution.

(15) The method for producing a toner according to item (13) above, wherein the mixed solution obtained in said mixing step is used as it is as said dispersion substantially without removing said solvent from said mixed solution, and said solvent is removed during the passing of said dispersion through said solidification unit.

(16) The method for producing a toner according to item (13) above, wherein said dispersion is prepared by removing at least a part of said solvent after said mixing step.

(17) The method for producing a toner according to item (13) above, wherein said solvent is removed by heating.

(18) The method for producing a toner according to any one of items (1) to (3) above, wherein said dispersoid in said dispersion has an average particle size of from 0.05 to 1.0 μm.

(19) The method for producing a toner according to any one of items (1) to (3) above, wherein when the average particle size of said dispersoid in said dispersion is designated as Dm (μm) and the average particle size of the toner particle produced is designated as Dt (μm), these average particle sizes satisfy the relationship of $0.005 \leqq Dm/Dt \leqq 0.5$.

(20) The method for producing a toner according to any one of items (1) to (3) above, wherein said dispersion has a content of said dispersoid of from 1 to 99 wt %.

(21) The method for producing a toner according to any one of items (1) to (3) above, wherein the ejection amount in one droplet portion of said dispersion ejected from said head unit is from 0.05 to 500 pl.

(22) The method for producing a toner according to any one of items (1) to (3) above, wherein when the average particle size of said dispersion ejected from said head unit is designated as Dd (μm) and the average particle size of said dispersoid in said dispersion is designated as Dm (μm), these average particle sizes satisfy the relationship of $Dm/Dd<0.5$.

(23) The method for producing a toner according to any one of items (1) to (3) above, wherein when the average particle size of said dispersion ejected from said head unit is designated as Dd (μm) and the average particle size of the toner particle produced is designated as Dt (μm), these average particle sizes satisfy the relationship of $0.05 \leqq Dt/Dd \leqq 1.0$.

(24) The method for producing a toner according to item (2) above, wherein said head unit has a dispersion storing section of storing said dispersion, a piezoelectric body of applying a pressure pulse to said dispersion stored in said dispersion storing section, and an ejection portion of ejecting said dispersion by said pressure pulse.

(25) The method for producing a toner according to item (24) above, wherein said ejection portion has a substantially circular shape and the diameter thereof is from 5 to 500 μm.

(26) The method for producing a toner according to item (2) above, wherein said pressure pulse for ejecting said dispersion from said head unit is converged by an acoustic lens.

(27) The method for producing a toner according to item (2) (24) above, wherein the frequency of said piezoelectric body is from 10 kKz to 500 MHz.

(28) The method for producing a toner according to item (2) above, further comprising applying heat to said dispersion to be ejected from said head unit.

(29) The method for producing a toner according to item (3) above, wherein said head unit has a dispersion storing section of storing said dispersion, a heating element of giving a heat energy to said dispersion stored in said dispersion storing section to generate a bubble in said dispersion storing section, and an ejection portion of ejecting said dispersion by utilizing the change in volume of said bubble.

(30) The method for producing a toner according to item (29) above, wherein said ejection portion has a substantially circular shape and the diameter thereof is from 5 to 500 μm.

(31) The method for producing a toner according to item (29) above, wherein said heat energy is generated by applying an alternating voltage to said heating element.

(32) The method for producing a toner according to item (31) above, wherein the alternating voltage applied to said heating element has a frequency of from 1 to 50 kHz.

(33) The method for producing a toner according to any one of items (1) to (3) above, wherein said dispersion ejected from said head unit is released into a gas stream flowing substantially in one direction.

(34) The method for producing a toner according to any one of items (1) to (3) above, wherein said dispersion is ejected from a plurality of said head units.

(35) The method for producing a toner according to item (34) above, wherein said dispersion is ejected while jetting out a gas from spaces between each adjacent head units of said plural head units.

(36) The method for producing a toner according to item (35) above, wherein said gas to be jetted out from the spaces has a humidity of 50% RH or less.

(37) The method for producing a toner according to item (34) above, wherein the timing of ejecting said dispersion is differentiated at least between each two adjacent head units of said plural head units.

(38) The method for producing a toner according to any one of items (1) to (3) above, wherein said dispersion is ejected into said solidification unit while applying a voltage having the same polarity with said dispersion.

(39) The method for producing a toner according to any one of items (1) to (3) above, wherein said dispersion is ejected from said head unit so as to have an initial ejection speed of from 0.1 to 10 m/sec.

(40) The method for producing a toner according to any one of items (1) to (3) above, wherein said dispersion in said head unit has a viscosity of from 5 to 3,000 cps.

(41) The method for producing a toner according to any one of items (1) to (3) above, wherein said dispersion medium is removed in said solidification unit.

(42) The method for producing a toner according to any one of items (1) to (3) above, wherein said solidification unit has an inner pressure of 0.15 MPa or less.

(43) The method for producing a toner according to any one of items (1) to (3) above, wherein at least a part of component(s) of said dispersoid in said dispersion is dissolved in a solvent.

(44) The method for producing a toner according to item (43) above, wherein at least a part of said solvent contained in said dispersoid is removed in said solidification unit.

(45) The method for producing a toner according to any one of items (1) to (3) above, wherein said dispersion ejected from said head unit is in the state of at least a part of said dispersoid being softened or melted.

(46) The method for producing a toner according to any one of items (1) to (3) above, further comprising cooling said dispersion ejected from said head unit in said solidification unit.

(47) The method for producing a toner according to any one of items (1) to (3) above, further comprising heating said dispersion ejected from said head unit in said solidification unit.

(48) A toner produced by a method according to any one of items (1) to (3) above.

(49) The toner according to item (48) above, having an average particle size of from 2 to 20 μm.

(50) The toner according to item (48) above, having a standard deviation of particle size among particles of 1.5 μm or less.

(51) The toner according to item (48) above, having an average circularity R represented by the following formula (I) of 0.95 or more:

$$R=L_0/L_1 \quad \text{(I)}$$

wherein $L_1$ (μm) represents a circumferential length of a projected image of a toner particle to be measured and $L_0$ (μm) represents a circumferential length of a true circle having the same area as the projected image of a toner particle to be measured.

(52) The toner according to item (48) above, having a standard deviation of average circularity among particles of 0.02 or less.

(53) The toner according to item (48) above, which is constituted by an aggregate resulting from aggregation of said dispersoids.

(54) An apparatus for producing a toner, which performs a method according to any one of items (1) to (3) above.

(55) An apparatus for producing a toner, which produces a toner by using a dispersion comprising a dispersion medium having finely dispersed therein a dispersoid containing a raw material for the production of a toner, said apparatus comprising a head unit of ejecting said dispersion, a dispersion feed unit of feeding said dispersion to said head unit, and a solidification unit of solidifying said dispersion ejected from said head unit and thereby forming it into a particulate shape, said head unit having a dispersion storing section of storing said dispersion, an ejection energy-imparting member of applying an ejection energy to said dispersion stored in said dispersion storing section, and an ejection portion of ejecting said dispersion by the ejection energy.

(56) The apparatus for producing a toner according to item (55) above, wherein said ejection energy-imparting member is a piezoelectric body of applying a pressure pulse to said dispersion stored in said dispersion storing section, and said dispersion is ejected by the pressure pulse.

(57) The apparatus for producing a toner according to item (56) above, further comprising an acoustic lens of converging the pressure pulse generated by said piezoelectric body.

(58) The apparatus for producing a toner according to item (57) above, wherein said acoustic lens is disposed to take the focus in the vicinity of said ejection portion.

(59) The apparatus for producing a toner according to item (57) or (58) above, further comprising a diaphragm member having a shape constringed toward said ejection portion, said diaphragm member being disposed between said acoustic lens and said ejection portion.

(60) The apparatus for producing a toner according to item (55) above, wherein said ejection energy-imparting member is a heating element of giving a heat energy to said dispersion stored in said dispersion storing section to generate a bubble in said dispersion storing section, and said dispersion is ejected by a volume change of the bubble.

(61) The apparatus for producing a toner according to item (60) above, wherein said heating element generates heat by the application of an alternating voltage.

(62) The apparatus for producing a toner according to any one of items (55), (56) and (60) above, wherein said dispersion feed unit has a stirring member of stirring said dispersion.

(63) The apparatus for producing a toner according to according to any one of items (55), (56) and (60) above, which has a transportation member of transporting said dispersion ejected from said head unit.

(64) The apparatus for producing a toner according to item (63) above, wherein said transportation member is a gas stream feed member of feeding a gas stream.

(65) The apparatus for producing a toner according to any one of items (55), (56) and (60) above, which has a plurality of said head units.

(66) The apparatus for producing a toner according to item (65) above, further having gas jetting ports for jetting a gas in spaces between each adjacent head units of said plural head units.

(67) The apparatus for producing a toner according to item (65) above, wherein the timing of ejecting said dispersion is differentiated at least between each two adjacent head units of said plural head units.

(68) The apparatus for producing a toner according to any one of items (55), (56) and (60) above, having a voltage applying member of applying a voltage to said solidification unit.

(69) The apparatus for producing a toner according to any one of items (55), (56) and (60) above, wherein said ejection portion has a substantially circular shape and the diameter thereof is from 5 to 500 μm.

(70) The apparatus for producing a toner according to any one of items (55), (56) and (60) above, having a pressure adjusting member of adjusting a pressure inside said solidification unit.

BRIEF DESCRIPTION OF THE DRWAINGS

DETAILED DESCRIPTION OF PREFERRED EMBODIMENTS

Preferred embodiments of the method for producing a toner, the toner, and the apparatus for producing a toner of the present invention are described in detail below by referring to the attached drawings.

Figure 1:
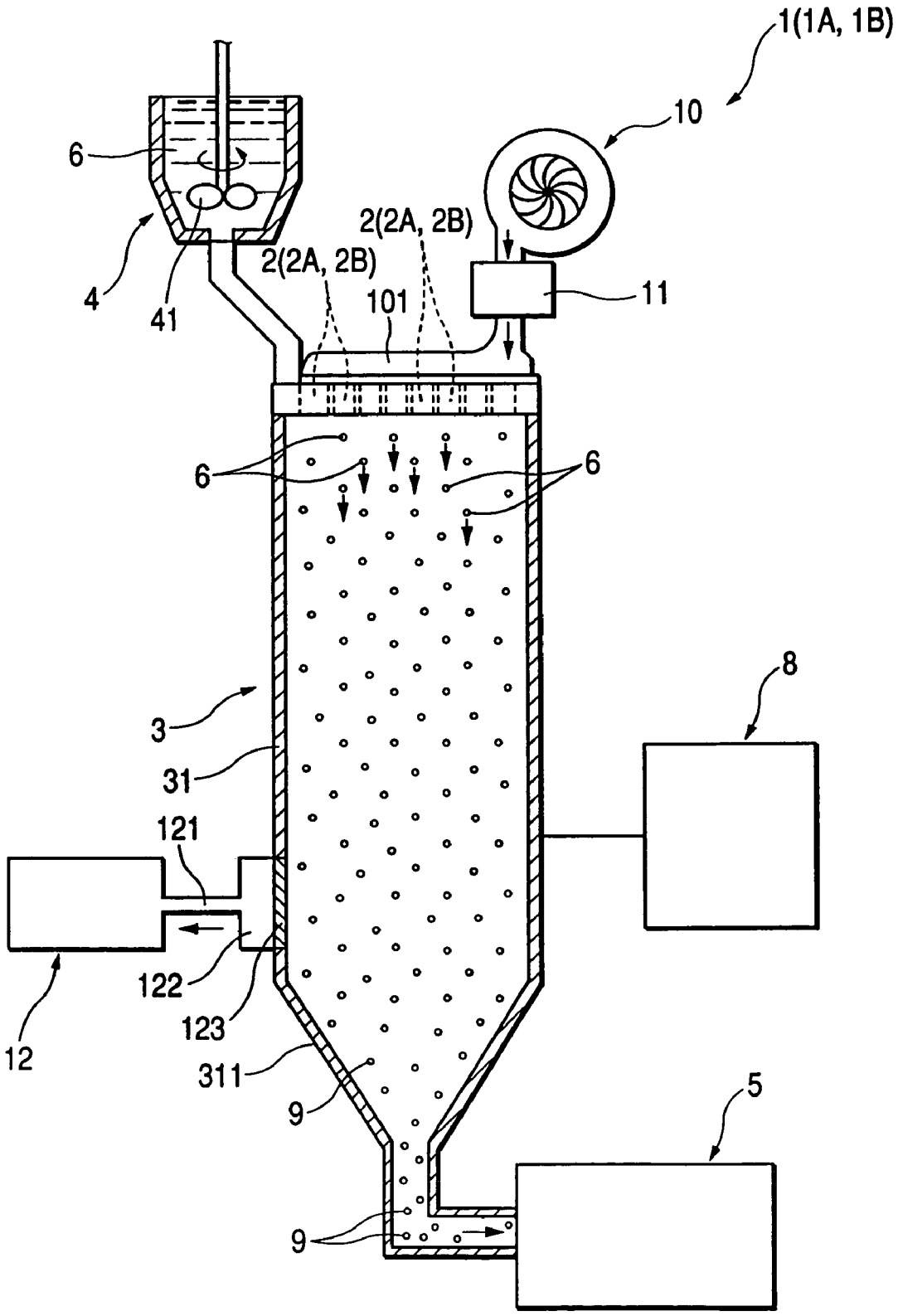
FIG. 1 is a longitudinal sectional view schematically showing one example of the toner producing apparatus of the present invention.
Figure 2:
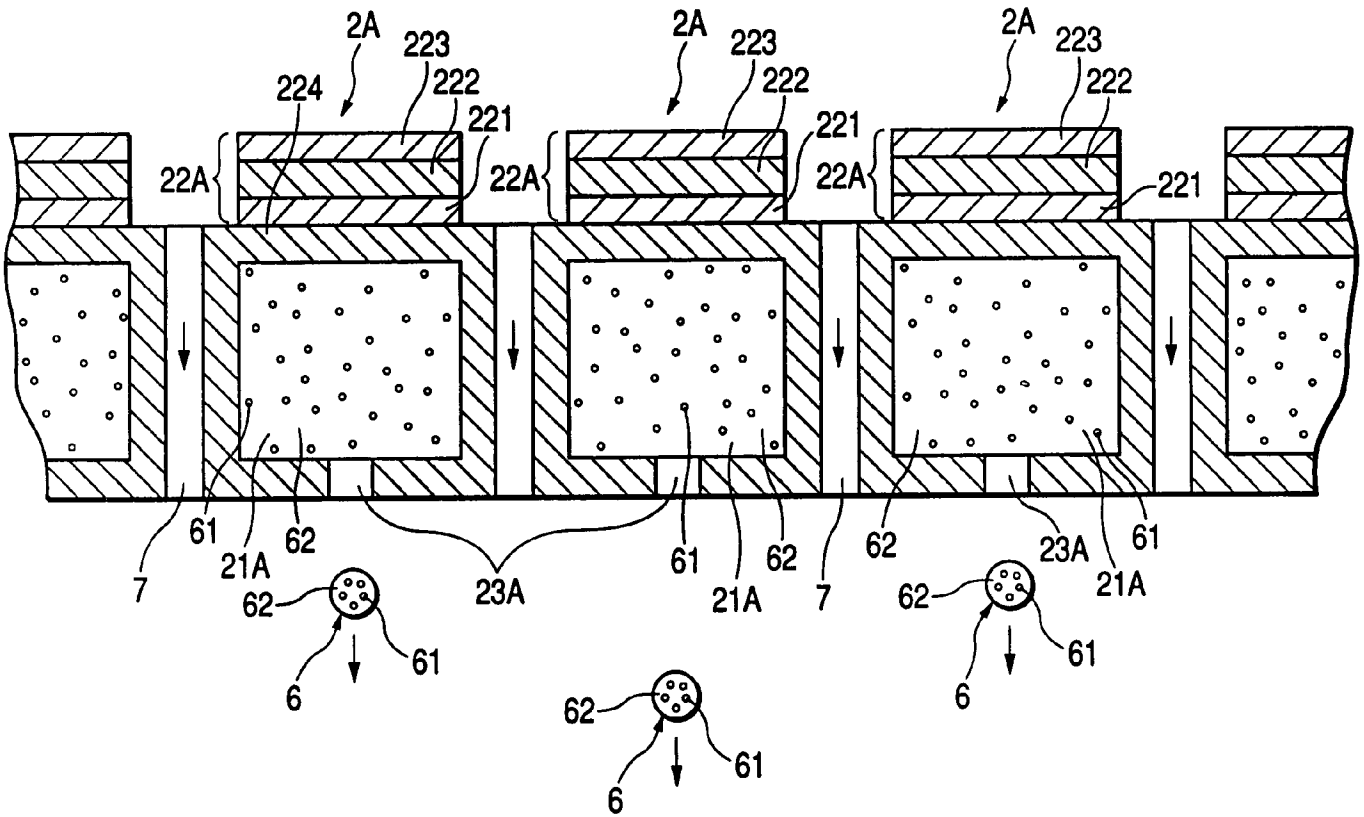
FIG. 2 is an enlarged sectional view showing the vicinity of the head unit of toner producing apparatus 1A of the present invention.
Figure 8:
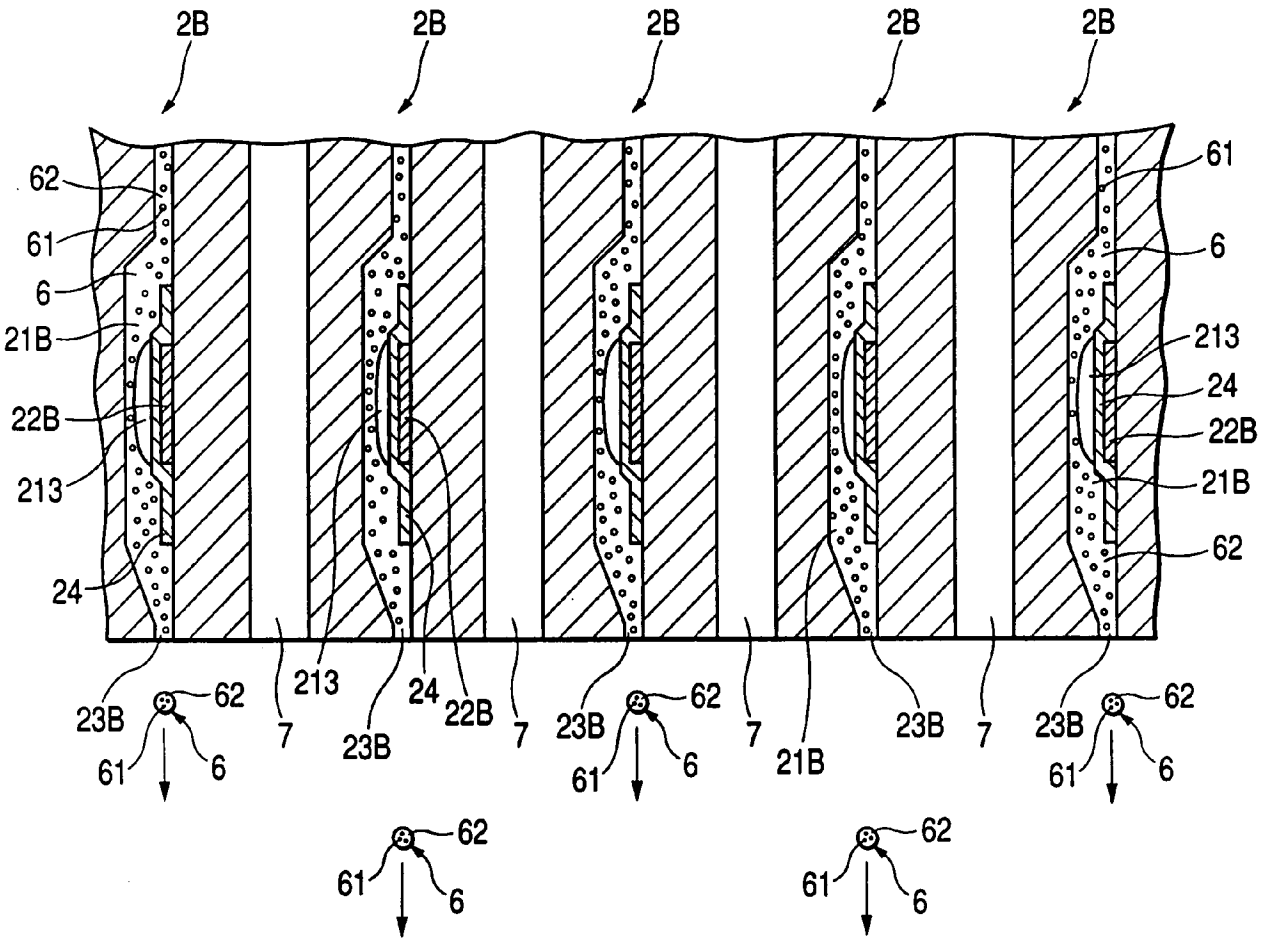
FIG. 8 is an enlarged sectional view showing the vicinity of the head unit of toner producing apparatus 1B of the present invention.

FIG. 1 is a longitudinal sectional view schematically showing a first embodiment of the apparatus for producing a toner of the present invention. FIGS. 2 and 8 are each an enlarged sectional view showing the vicinity of the head unit of the toner producing apparatus shown in FIG. 1.

Dispersion

The dispersion 6 for use in the present invention is described. The toner of the present invention is produced using the dispersion 6. The dispersion 6 has a constitution that a dispersoid (dispersion phase) 61 is finely dispersed in a dispersion medium 62.

<Dispersion Medium>

The dispersion medium 62 may be any material as long as it can disperse the dispersoid 61 which is described later, but the dispersion medium is preferably constituted mainly by a material which is generally used as a solvent.

Examples of such a material include inorganic solvents such as water, carbon disulfide and carbon tetrachloride, and organic solvents, for example, ketone-base solvents such as methyl ethyl ketone (MEK), acetone, diethyl ketone, methyl isobutyl ketone (MIBK), methyl isopropyl ketone (MIPK), cyclohexanone, 3-heptanone and 4-heptanone; alcohol-base solvents such as methanol, ethanol, n-propanol, isopropanol, n-butanol, i-butanol, tert-butanol, 3-methyl-1-butanol, 1-pentanol, 2-pentanol, n-hexanol, cyclohexanol, 1-heptanol, 1-octanol, 2-octanol, 2-methoxyethanol, allyl alcohol, furfuryl alcohol and phenol; ether-base solvents such as diethyl ether, dipropyl ether, diisopropyl ether, dibutyl ether, 1,2-dimethoxyethane (DME), 1,4-dioxane, tetrahydrofuran (THF), tetrahydropyrane (THP), anisole, diethylene glycol dimethyl ether (diglyme) and 2-methoxyethanol; cellosolve-base solvents such as methyl cellosolve, ethyl cellosolve and phenyl cellosolve; aliphatic hydrocarbon-base solvents such as hexane, pentane, heptane, cyclohexane, methylcyclohexane, octane, didecane, methylcyclohexene and isoprene; aromatic hydrocarbon-base solvents such as toluene, xylene, benzene, ethylbenzene and naphthalene; aromatic heterocyclic compound-base solvents such as pyridine, pyrazine, furan, pyrrole, thiophene, 2-methylpyridine, 3-methylpyridine, 4-methylpyridine and furfuryl alcohol; amide-base solvents such as N,N-dimethylformamide (DMF) and N,N-dimethylacetamide (DMA); halogen compound-base solvents such as dichloromethane, chloroform, 1,2-dichloroethane, trichloroethylene and chlorobenzene; ester-base solvents such as acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate and ethyl benzoate; amine-base solvents such as trimethylamine, hexylamine, triethylamine and aniline; nitrile-base solvents such as acrylonitrile and acetonitrile; nitro-base solvents such as nitromethane and nitroethane; and aldehyde-base solvents such as acetaldehyde, propionaldehyde, butylaldehyde, pentanal and acrylaldehyde. One member selected from these materials can be used or a mixture of two or more thereof may be used.

Among these materials, the dispersion medium is preferably constituted mainly by water and/or a liquid having excellent compatibility with water (for example, a liquid having a solubility of 30 g or more in 100 g of water at 25° C.). By this constitution, for example, the dispersibility of the dispersoid 61 in the dispersion medium 62 can be enhanced and the dispersoid 61 in the dispersion 6 can have a relatively small particle size and be less varied in the size. As a result, the finally obtained toner particle 9 is less varied in the size and shape among particles and has a high circularity.

In the case of using a mixture of multiple components as the constituent material of the dispersion medium 62, the constituent material of the dispersion medium is preferably a mixture such that an azeotropic mixture (minimum boiling point azeotropic mixture) can be formed at least between two components constituting the mixture. By such use, the dispersion medium 62 can be removed with good efficiency in the solidification unit of an apparatus for producing a toner, which is described later. Furthermore, the dispersion medium 62 can be removed at a relatively low temperature in the solidification unit of an apparatus for producing a toner, which is described later, and the obtained toner particle 9 can be more effectively prevented from deterioration in the properties. Examples of the liquid capable of forming an azeotropic mixture with water include carbon disulfide, carbon tetrachloride, methyl ethyl ketone (MEK), acetone, cyclohexanone, 3-heptanone, 4-heptanone, ethanol, n-propanol, isopropanol, n-butanol, i-butanol, tert-butanol, 3-methyl-1-butanol, 1-pentanol, 2-pentanol, n-hexanol, cyclohexanol, 1-heptanol, 1-octanol, 2-octanol, 2-methoxyethanol, allyl alcohol, furfuryl alcohol, phenol, dipropyl ether, dibutyl ether, 1,4-dioxane, anisole, 2-methoxyethanol, hexane, heptane, cyclohexane, methylcyclohexane, octane, didecane, methylcyclohexene, isoprene, toluene, benzene, ethylbenzene, naphthalene, pyridine, 2-methylpyridine, 3-methylpyridine, 4-methylpyridine, furfuryl alcohol, chloroform, 1,2-dichloroethane, trichloroethylene, chlorobenzene, acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate, ethyl benzoate, trimethylamine, hexylamine, triethylamine, aniline, acrylonitrile, acetonitrile, nitromethane, nitroethane and acrylaldehyde.

The boiling point of the dispersion medium 62 is not particularly limited but this is preferably 180° C. or less, more preferably 150° C. or less, still more preferably from 35 to 130° C. When the boiling point of the dispersion medium 62 is relatively low as such, the dispersion medium 62 can be relatively easily removed in the solidification unit of an apparatus for producing a toner, which is described later. Furthermore, when such a material is used as the dispersion medium 62, particularly the residual amount of the dispersion medium 62 in the finally obtained toner particle 9 can be reduced. As a result, the reliability of the toner is more elevated.

The dispersion medium 62 may contain components other than the above-described material. For example, the dispersion medium 62 may contain a material described later as examples of the constituent component of the dispersoid 61, or various additives such as inorganic fine powder (e.g., silica, titanium oxide, iron oxide) and organic fine powder (e.g., fatty acid, fatty acid metal salt).

<Dispersoid>

The dispersoid 61 is usually constituted by a material containing at least a resin (or a monomer, a dimer, an oligomer or the like as a precursor of the resin) which is a main component.

The constituent material of the dispersoid 61 is described below.

(1) Resin (Binder Resin):

Examples of the resin (binder resin) include styrene-base resins which are a homopolymer or copolymer containing styrene or a styrene substitution product, such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer, styrene-methacrylic acid ester copolymer, styrene-acrylic acid ester-methacrylic acid ester copolymer, styrene-α-methyl chloroacrylate copolymer, styrene-acrylonitrile-acrylic acid ester copolymer and styrene-vinyl methyl ether copolymer, a polyester resin, an epoxy resin, a urethane-modified epoxy resin, a silicone-modified epoxy resin, a vinyl chloride resin, a rosin-modified maleic acid resin, a phenyl resin, a polyethylene, a polypropylene, an ionomer resin, a polyurethane resin, a silicone resin, a ketone resin, an ethylene-ethyl acrylate copolymer, a xylene resin, a polyvinyl butyral resin, a terpene resin, a phenolic resin and an aliphatic or alicyclic hydrocarbon resin. These can be used singly or in combination of two or more thereof. In the case where the raw material in the dispersoid 61 is polymerized in the solidification unit of an apparatus for producing a toner, which is described later, and thereby a toner is produced, a monomer, a dimer, an oligomer or the like of the above-described resin material is usually used.

The content of the resin in the dispersoid 61 is not particularly limited but this is preferably from 2 to 98 wt %, more preferably from 5 to 95 wt %.

(2) Solvent:

The dispersoid 61 may contain a solvent capable of dissolving at least a part of the components thereof. By containing such a solvent, the fluidity of the dispersoid 61 in the dispersion 6 can be enhanced and the dispersoid 61 in the dispersion 6 can have a relatively small particle size and be less varied in the size. As a result, the finally obtained toner particle 9 is less varied in the size and shape among particles and has a high circularity.

The solvent may be any as long as it dissolves at least a part of the components constituting the dispersoid 61, but is preferably a solvent which can be easily removed in the solidification unit of an apparatus for producing a toner, which is described later.

The solvent preferably has low compatibility with the dispersion medium 62 (for example, the solubility in 100 g of the dispersion medium at 25° C. is 30 g or less). By having such low compatibility, the dispersoid 61 in the dispersion 6 can be finely dispersed in the stable state.

The composition of the solvent can be appropriately selected according to, for example, the above-described resin, the composition of coloring agent or the composition of dispersion medium.

Examples of the solvent include inorganic solvents such as water, carbon disulfide and carbon tetrachloride, and organic solvents, for example, ketone-base solvents such as methyl ethyl ketone (MEK), acetone, diethyl ketone, methyl isobutyl ketone (MIBK), methyl isopropyl ketone (MIPK), cyclohexanone, 3-heptanone and 4-heptanone; alcohol-base solvents such as methanol, ethanol, n-propanol, isopropanol, n-butanol, i-butanol, tert-butanol, 3-methyl-1-butanol, 1-pentanol, 2-pentanol, n-hexanol, cyclohexanol, 1-heptanol, 1-octanol, 2-octanol, 2-methoxyethanol, allyl alcohol, furfuryl alcohol and phenol; ether-base solvents such as diethyl ether, dipropyl ether, diisopropyl ether, dibutyl ether, 1,2-dimethoxyethane (DME), 1,4-dioxane, tetrahydrofuran (THF), tetrahydropyrane (THP), anisole, diethylene glycol dimethyl ether (diglyme) and 2-methoxyethanol; cellosolve-base solvents such as methyl cellosolve, ethyl cellosolve and phenyl cellosolve; aliphatic hydrocarbon-base solvents such as hexane, pentane, heptane, cyclohexane, methylcyclohexane, octane, didecane, methylcyclohexene and isoprene; aromatic hydrocarbon-base solvents such as toluene, xylene, benzene, ethylbenzene and naphthalene; aromatic heterocyclic compound-base solvents such as pyridine, pyrazine, furan, pyrrole, thiophene, 2-methylpyridine, 3-methylpyridine, 4-methylpyridine and furfuryl alcohol; amide-base solvents such as N,N-dimethylformamide (DMF) and N,N-dimethylacetamide (DMA); halogen compound-base solvents such as dichloromethane, chloroform, 1,2-dichloroethane, trichloroethylene and chlorobenzene; ester-base solvents such as acetylacetone, ethyl acetate, methyl acetate, isopropyl acetate, isobutyl acetate, isopentyl acetate, ethyl chloroacetate, butyl chloroacetate, isobutyl chloroacetate, ethyl formate, isobutyl formate, ethyl acrylate, methyl methacrylate and ethyl benzoate; amine-base solvents such as trimethylamine, hexylamine, triethylamine and aniline; nitrile-base solvents such as acrylonitrile and acetonitrile; nitro-base solvents such as nitromethane and nitroethane; and aldehyde-base solvents such as acetaldehyde, propionaldehyde, butylaldehyde, pentanal and acrylaldehyde. One member selected from these materials can be used or a mixture of two or more thereof may be used. Among these, the dispersoid preferably contains an organic solvent, more preferably one or more selected from the ether-base solvents, cellosolve-base solvents, aliphatic hydrocarbon-base solvents, aromatic hydrocarbon-base solvents, aromatic heterocyclic compound-base solvents, amide-base solvents, halogen compound-base solvents, ester-base solvents, amine-base solvents, nitrile-base solvents, nitro-base solvents and aldehyde-base solvents. By using such a solvent, the above-described components each can be relatively easily dispersed to a satisfactorily uniform state in the dispersoid 61.

The dispersion 6 usually contains a coloring agent. As the coloring agent, for example, a pigment, a dye or the like can be used. Examples of the pigment and dye include carbon black, spirit black, lamp black (C.I. No. 77266), magnetite, titanium black, chrome yellow, cadmium yellow, Mineral Fast Yellow, naples yellow, Naphthol Yellow S, Hansa Yellow G, Permanent Yellow NCG, chrome yellow, Benzidine Yellow, Quinoline Yellow, Tartrazine Lake, chrome orange, molybdenum orange, Permanent Orange GTR, pyrazolone orange, Benzidine Orange G, Cadmium Red, Permanent Red 4R, Watching Red Ca salt, eosine lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, ultramarine, Aniline Blue, Phthalocyanine Blue, chalcone oil blue, chrome green, chromium oxide, Pigment Green B, Malachite Green Lake, Phthalocyanine Green, Final Yellow Green G, Rhodamine 6G, quinacridone, Rose Bengale (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I.

Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, nigrosine dyes (C.I. No. 50415B), metal complex salt dyes, silica, aluminum oxide, magnetite, maghemite, various ferrites, metal oxides such as cupric oxide, nickel oxide, zinc oxide, zirconium oxide, titanium oxide and magnesium oxide, and magnetic materials containing a magnetic metal such as Fe, Co and Ni. These can be used singly or in combination of two or more thereof. In the dispersion 6, the coloring agent is usually contained in the dispersoid 61.

The content of the coloring agent in the dispersion 6 is not particularly limited but this is preferably from 0.1 to 10 wt %, more preferably from 0.3 to 3.0 wt %. If the coloring agent content is less than this lower limit, depending on the kind of the coloring agent, a visible image having a sufficiently high density may not be formed, whereas if the coloring agent exceeds the above-described upper limit, the finally obtained toner may be reduced in the fixing property or electrical charging property.

The dispersion 6 may contain a wax. The wax is usually used for the purpose of improving releasability. Examples of the wax include natural waxes such as vegetable waxes (e.g., candelilla wax, carnauba wax, rice wax, cotton wax, Japan wax), animal waxes (e.g., bees wax, lanolin), mineral waxes (e.g., montan wax, ozocerite, ceresine) and petroleum waxes (e.g., paraffin wax, micro wax, microcrystalline wax, petrolatum); synthetic hydrocarbon waxes such as Fisher-Tropsch wax, polyethylene wax (polyethylene resin), polypropylene wax (polypropylene resin), oxidized polyethylene wax and oxidized polypropylene wax; and synthetic waxes such as aliphatic amide, ester, ketone and ether, e.g., 12-hydroxystearic acid amide, stearic acid amide, phthalic anhydride imide and chlorinated hydrocarbon. These can be used singly or in combination of two or more thereof. As the wax, a crystalline polymer resin having a low molecular weight may also be used and examples of the crystalline polymer resin which can be used include a crystalline polymer having a long alkyl group in the side chain, such as homopolymer or copolymer of polyacrylate (e.g., poly-n-stearyl methacrylate, poly-n-lauryl methacrylate), for example, n-stearyl acrylate-ethyl methacrylate copolymer.

The content of the wax in the dispersion 6 is not particularly limited but this is preferably 1.0 wt % or less, more preferably 0.5 wt % or less. If the wax content is too large, the wax is liberated and becomes coarse in the finally obtained toner particle and seepage or the like of the wax out to the toner particle surface seriously takes place, giving rise to reduction in the transfer efficiency of toner.

The softening point of the wax is not particularly limited but this is preferably from 50 to 180° C., more preferably from 60 to 160° C.

The dispersion 6 may contain components other than those described above. Examples of such components include an emulsifying dispersant, a charge control agent and a magnetic powder. Among these, when an emulsifying dispersant is used, for example, the dispersibility of the dispersoid 61 in the dispersion 6 can be improved. Examples of the emulsifying dispersant include an emulsifier, a dispersant and a dispersion aid.

Examples of the dispersant include inorganic dispersants such as tricalcium phosphate; nonionic organic dispersants such as polyvinyl alcohol, carboxymethyl cellulose and polyethylene glycol; anionic organic dispersants such as tristearic acid metal salt (e.g., aluminum salt), distearic acid metal salt (e.g., aluminum salt, barium salt), stearic acid metal salt (e.g., calcium salt, lead salt, zinc salt), linoleic acid metal salt (e.g., cobalt salt, manganese salt, lead salt, zinc salt), octanoic acid metal salt (e.g., aluminum salt, calcium salt, cobalt salt), oleic acid metal salt (e.g., calcium salt, cobalt salt), palmitic acid metal salt (e.g., zinc salt), naphthenic acid metal salt (e.g., calcium salt, cobalt salt, manganese salt, lead salt, zinc salt), resin acid metal salt (e.g., calcium salt, cobalt salt, manganese salt, lead salt, zinc salt), polyacrylic acid metal salt (e.g., sodium salt), polymethacrylic acid metal salt (e.g., sodium salt), polymaleic acid metal salt (e.g., sodium salt), acrylic acid-maleic acid copolymer metal salt (e.g., sodium salt) and polystyrenesulfonic acid metal salt (e.g., sodium salt); and cationic organic dispersants such as quaternary ammonium salt. Among these, nonionic organic dispersants and anionic organic dispersants are preferred.

The content of the dispersant in the dispersion 6 is not particularly limited but this is preferably 3.0 wt % or less, more preferably from 0.01 to 1.0 wt %.

Examples of the dispersion aid include anionic, cationic and nonionic surfactants.

The dispersion aid is preferably used in combination with a dispersant. In the case where the dispersion 6 contains a dispersant, the content of the dispersion aid in the dispersion 6 is not particularly limited but this is preferably 2.0 wt % or less, more preferably from 0.005 to 0.5 wt %.

Examples of the charge control agent include metal salts of benzoic acid, metal salts of salicylic acid, metal salts of alkylsalicylic acid, metal salts of catechol, metal-containing bisazo dyes, nigrosine dyes, tetraphenyl borate derivatives, quaternary ammonium salts, alkyl-pyridinium salts, chlorinated polyesters and nitrofunic acid.

Examples of the magnetic powder include magnetite, maghemite, various ferrites, metal oxides such as cupric oxide, nickel oxide, zinc oxide, zirconium oxide, titanium oxide and magnesium oxide, and those constituted by a magnetic material containing a magnetic metal such as Fe, Co and Ni.

In the dispersion 6, for example, zinc stearate, zinc oxide or cerium oxide may be added in addition to the materials described above.

Also, in the dispersion 6, a component other than the dispersoid 61 may be dispersed as an insoluble matter. For example, in the dispersion 6, an inorganic fine powder such as silica, titanium oxide and iron oxide, or an organic fine powder such as fatty acid and fatty acid metal salt may be dispersed.

The dispersion 6 is in the state that the dispersoid 61 is finely dispersed in the dispersion medium 62.

The average particle size of the dispersoid 61 in the dispersion 6 is not particularly limited but this is preferably from 0.05 to 1.0 μm, more preferably from 0.1 to 0.8 μm. When the average particle size of the dispersoid 61 is in this range, the finally obtained toner particle 9 can have a sufficiently high circularity and excellent uniformity in the properties and shape among particles.

The content of the dispersoid 61 in the dispersion 6 is not particularly limited but this is preferably from 1 to 99 wt %, more preferably from 5 to 95 wt %. If the dispersoid 61 content is less than this lower limit, the circularity of the finally obtained toner particle 9 is liable to decrease, whereas if the dispersoid 6 content exceeds the above-described upper limit, depending on the composition or the like of the dispersion medium 62, the viscosity of the dispersion 6 increases and the finally obtained particle 9 is liable to vary widely in the shape and size.

The dispersoid 61 is preferably a liquid (for example, in a solution state or in a melted state) in the dispersion 6. By being in such a state, the average particle size of the dispersoid 61 finely dispersed in the dispersion medium 62 can be easily adjusted to fall within the above-described range.

The composition of the dispersoid 61 dispersed in the dispersion medium 62 may be almost the same or different among respective particles. For example, the dispersion 6 may contain a dispersoid 61 mainly constituted by a resin material and a dispersoid 61 mainly constituted by a wax.

The dispersion 6 is preferably an O/W emulsion, namely, it is preferred that an oily (here, a liquid having a small solubility in water) dispersoid 61 is dispersed in an aqueous dispersion medium 62. By this constitution, a toner less varied in the shape and size among particles can be stably produced. Furthermore, by the use of an aqueous solution for the dispersion medium 62, the amount of the organic solvent volatilized in the solidification unit of an apparatus for producing a toner, which is described later, can be reduced or the organic solvent can be substantially prevented from volatilization. As a result, a toner can be produced by a method of scarcely giving an adverse effect on the environment.

When the average particle size of the dispersoid 61 in the dispersion 6 is designated as Dm (μm) and the average particle size of the toner particle 9 is designated as Dt (μm), these average particle sizes preferably satisfy the relationship of $0.005 \leqq Dm/Dt \leqq 0.5$, more preferably $0.01 \leqq Dm/Dt \leqq 0.2$. By satisfying this relationship, a toner particularly reduced in the fluctuation of shape and size among particles can be obtained.

The dispersion 6 described above can be prepared, for example, by the following method.

First, an aqueous solution is prepared by adding, if desired, a dispersant and/or a dispersion medium to water or a liquid having excellent compatibility with water.

Separately, a resin solution containing a resin as a main component of toner or a precursor of the resin (hereinafter, the resin and a precursor thereof are sometimes collectively called a "resin material") is prepared. In the preparation of the resin solution, for example, the above-described solvent may be used in addition to the resin material. Also, the resin solution may be a melted liquid obtained by heating the resin material.

Then, the resin solution is gradually added dropwise to the aqueous solution under stirring and thereby a dispersion 6 where a dispersoid 61 containing a resin material is dispersed in an aqueous dispersion medium 62 is obtained. By preparing the dispersion 6 using such a method, the circularity of the dispersoid 61 in the dispersion 6 can be more enhanced. As a result, a toner particle 9 particularly high in the circularity and particularly small in the fluctuation of shape among particles is obtained. At the dropwise addition of the resin solution, the aqueous solution and/or resin solution may be heated. When a solvent is used in the preparation of the resin solution, at least a part of the solvent contained in the dispersoid 61 may be removed, for example, by heating the dispersion 6 obtained after the dropwise addition or placing it in a reduced pressure atmosphere.

One example of the preparation method for the dispersion 6 is described above, however, the dispersion is not limited to those prepared by such a method. For example, the dispersion 6 may also be prepared by the following method.

First, an aqueous solution is prepared by adding, if desired, a dispersant and/or a dispersion medium to water or a liquid having excellent compatibility with water.

Separately, a powdery or particulate material containing a resin material is prepared.

Then, this powdery or particulate material is gradually charged into the aqueous solution under stirring and thereby a dispersion 6 where a dispersoid 61 containing a resin material is dispersed in an aqueous dispersion medium 62 is obtained. When the dispersion 6 is prepared by such a method, the organic solvent can be substantially prevented from volatilizing in the solidification unit of an apparatus for producing a toner, which is described later. As a result, a toner can be produced by a method of scarcely giving an adverse effect on the environment. At the time of charging the above-described material, for example, the aqueous solution may be heated.

Alternatively, the dispersion 6 may be prepared by the following method.

A resin dispersion having dispersed therein at least a resin material, and a coloring agent dispersion having dispersed therein a coloring agent are prepared.

Then, the resin dispersion and the coloring agent dispersion are mixed and stirred. At this time, if desired, a coagulant such as inorganic metal salt may be added while stirring.

After stirring for a predetermined time, an aggregate resulting from aggregation of the resin material and the coloring agent is formed. As a result, a dispersion 6 where the aggregate is dispersed as a dispersoid 61 is obtained.

Apparatus for Producing Toner

The apparatus 1 for producing a toner of the present invention comprises a head unit 2 of ejecting the above-described dispersion 6, a dispersion feed unit 4 of feeding the dispersion 6 to the head unit 2, a solidification unit of transporting the dispersion 6 ejected from the head unit 2, and a recovery unit 5 of recovering the produced toner particle 9.

In the dispersion feed unit 4, the dispersion 6 prepared as above is stocked. The dispersion is fed to the head unit 2.

The dispersion feed unit 4 may be sufficient if it has a function of feeding the dispersion 6 to the head unit 2, but, as shown in the Figure, this unit may have a stirring member 41 of stirring the dispersion 6. By having this member, for example, even when the dispersoid 61 is difficult to disperse in the dispersion medium, a dispersion 6 in the state of the dispersoid 61 being satisfactorily uniformly dispersed can be fed to the head unit 2.

Toner producing apparatus 1A according to a first aspect of the invention (which may hereinafter be referred to as "first toner producing apparatus") has a head unit 2A. The head unit 2A has a dispersion storing section 21A, a piezoelectric device 22A and an ejection portion 23A (FIG. 2).

In the dispersion storing section 21A, the dispersion 6 described above is stored.

The dispersion 6 stored in the dispersion storing section 21A is ejected to the solidification unit 3 from the ejection portion 23A by the pressure pulse of the piezoelectric device 22A.

The shape of the ejection portion 23A is not particularly limited but is preferably substantially circular. By having such a shape, the dispersion 6 ejected and the toner particle 9 formed can be enhanced in the sphericity.

When the ejection portion 23A has a substantially circular shape, the diameter (nozzle diameter) thereof is, for example, preferably from 5 to 500 μm, more preferably from 10 to 200 μm. If the diameter of the ejection portion 23A is less than this lower limit, clogging is readily generated and the dispersion 6 ejected varies widely in the size, whereas if the diameter of the ejection portion 23A exceeds the above-described upper limited, depending on the power relationship between the negative pressure in the dispersion storing section 21A and the surface tension of nozzle, the dispersion 6 ejected may embrace bubbles.

As shown in FIG. 2, the piezoelectric device 22A is constituted by a lower electrode (first electrode) 221, a piezoelectric body 222 and an upper electrode (second electrode) 223 which are stacked in this order. In other words, the piezoelectric derive 22A is constituted such that the piezoelectric body 222 is interposed between the upper electrode 223 and the lower electrode 221.

The piezoelectric device 22A functions as a vibration source and a vibrating plate 224 functions as vibrating due to vibration of the piezoelectric device (vibration source) 22A, whereby the internal pressure of the dispersion storing section 21A is momentarily increased.

In the head unit 2A, the piezoelectric body 222 does not deform when a predetermined ejection signal is not input from a piezoelectric device driving circuit (not shown), in other words, when a voltage is not applied between the lower electrode 221 and the upper electrode 223 of the piezoelectric device 22A. Therefore, the vibrating plate 224 does not deform and the volume of the dispersion storing section 21A does not change. As a result, the dispersion 6 is not ejected from the ejection portion 23A.

On the other hand, the piezoelectric body 222 deforms when a predetermined ejection signal is input from a piezoelectric device driving circuit, in other words, when a predetermined voltage is applied between the lower electrode 221 and the upper electrode 223 of the piezoelectric device 22A. As a result, the vibrating plate 224 greatly deflects (yielding to downward in FIG. 2) and the volume of the dispersion storing section 21A decreases (changes). At this time, the pressure inside the dispersion storing section 21A momentarily increases and a particulate dispersion 6 is ejected from the ejection portion 23A.

When one-time ejection of the dispersion 6 is completed, the piezoelectric device driving circuit stops applying a voltage between the lower electrode 221 and the upper electrode 223. As a result, the piezoelectric device 222 recovers almost its original shape and the volume of the dispersion storing section 21A increases. At this time, a pressure directed from the dispersion feed unit 4 toward the ejection portion 23A (a pressure in the positive direction) is acting on the dispersion 6. Therefore, an air is prevented from entering into the dispersion storing section 21A from the ejection portion 23A and a dispersion 6 in an amount commensurate with the ejection amount of the dispersion 6 is fed to the dispersion storing section 21A from the dispersion feed unit 4.

By performing such application of a voltage in a predetermined cycle, the piezoelectric device 22A vibrates and a particulate dispersion 6 is repeatedly ejected.

Thus, the first toner producing apparatus 1A of the present invention is characterized in that a dispersion having fluidity is ejected in the particulate form by the vibration of a piezoelectric body and this particulate solution is solidified, thereby obtaining a toner.

As for the method for producing a toner by using a raw material having fluidity, a spray dry method is conventionally known. The spray dry method is a method where a raw material for the production of a toner, which is dissolved in a solvent, is sprayed using a high-pressure gas and thereby, a fine powder is obtained as a toner. However, the spray dry method has the following problems.

That is, in the spray dry method, a raw material is sprayed using a high-pressure gas and therefore, the spraying conditions of the raw material cannot be precisely controlled, as a result, a toner particle having objective shape and size is difficult to produce with good efficiency. Furthermore, in the spray dry method, the particle size varies widely among particles formed by spraying (the width of the particle size distribution is large) and therefore, the moving speed also varies widely among particles. This causes collision or aggregation of sprayed particles before the sprayed raw material is solidified, and a powder of anomaly shapes is formed, as a result, the fluctuation in the shape and size sometimes more increases among finally obtained toner particles. As such, the toner obtained by the spray dry method varies widely in the shape and size among toner particles, therefore, the electric charging property, fixing property and the like also vary widely among toner particles, and the toner as a whole has low reliability. In the case of producing a toner particle having a relatively small size, the particle size distribution of toner particles is liable to be broad and the above-described tendency comes out more strongly.

On the other hand, in the toner producing apparatus 1A of the present invention, the dispersion is intermittently ejected drop by drop by a pressure pulse due to vibration of a piezoelectric body and therefore, the shape of the dispersion ejected is stabilized. As a result, a toner having a stable shape can be obtained and also, a toner particle having a high sphericity (a shape close to a geometrically complete sphere) can be relatively easily produced.

In the toner producing apparatus 1A of the present invention, the frequency of piezoelectric body, the opening area (nozzle diameter) of ejection portion, the temperature·viscosity of the dispersion, the ejection amount in one droplet portion of the dispersion, the content of the dispersoid occupying in the dispersion, the particle size of the dispersoid in the dispersion, and the like can be relatively precisely controlled. Hence, the toner to be produced can be easily controlled to have desired shape and size. Furthermore, by controlling these conditions, for example, the production amount of the toner can be easily and surely controlled.

In the toner producing apparatus 1A of the present invention, vibration of a piezoelectric body is used and, therefore, the dispersion can be ejected at predetermined intervals, so that the particulate dispersion ejected can be effectively prevented from colliding or aggregating with each other and a powder or the like of anomaly shapes can be hardly formed as compared with the case of using the conventional spray dry method.

Toner producing apparatus 1B according to a second aspect of the invention (which may hereinafter be referred to as "second toner producing apparatus") has a head unit 2B. The head unit 2B has a dispersion storing section 21B, a heating element 22B and an ejection portion 23B (FIG. 8).

The dispersion storing section 21B has a cylindrical form and in the inside thereof, the above-described dispersion 6 is stored.

The heating element 22B has a function of generating a heat energy by, for example, the application of a voltage. The heat energy generated from the heating element 22B rapidly heats the dispersion 6 stored in the dispersion storing section 21B to generate a bubble 213 in the dispersion storing section 21B through a film boiling or the like.

The dispersion 6 stored in the dispersion storing section 21B is ejected to the solidification unit 3 from the ejection portion 23B by the volume change of the bubble 213 generated in the dispersion storing section 21B.

Between the dispersion storing section 21B and the heating element 22B, a protective film 24 of preventing the dispersion 6 from coming into direct contact with the heating element 22B is provided.

The shape of the ejection portion 23B is not particularly limited but is preferably substantially circular. By having such a shape, the dispersion 6 ejected and the toner particle 9 formed can be enhanced in the sphericity.

When the ejection portion 23B has a substantially circular shape, the diameter (nozzle diameter) thereof is, for example, preferably from 5 to 500 μm, more preferably from 10 to 200 μm. If the diameter of the ejection portion 23B is less than this lower limit, clogging is readily generated in the vicinity of the ejection portion 23B, whereas if the diameter of the ejection portion 23B exceeds the above-described upper limit, the size of the ejected dispersion 6 in the liquid droplet form is sometimes difficult to control.

By repeatedly performing the generation of heat energy, the volume of a bubble 213 in the dispersion storing section 21B is changed with time (a bubble 213 is intermittently generated in the dispersion storing section 21B) and thereby a particulate dispersion 6 is repeatedly ejected from the dispersion storing section 21B.

Thus, the second toner producing apparatus 1B of the present invention is characterized in that the dispersion 6 is ejected in a particulate form by the volume change of a bubble which is generated, for example, by heat energy given by a heating element, and the ejected particulate dispersion is solidified to obtain a toner.

Comparing with the conventional spray dry method as described above, in the toner producing apparatus 1B of the present invention, the generation of heat energy is repeatedly performed and thereby the volume of bubble in the dispersion storing section is changed with time (a bubble is intermittently generated in the dispersion storing section). As a result, the dispersion is intermittently ejected drop by drop, so that a toner having a stable shape can be obtained and at the same time, the produced toner particle can be relatively easily made to have a high sphericity (a shape close to a geometrically complete sphere).

Particularly, the toner producing apparatus 1B of the present invention is characterized in that a dispersion (dispersion system) 6 comprising a dispersion medium 62 having dispersed therein a dispersoid 61 is used as the ejection solution ejected from the head unit.

The dispersion medium 62 generally has a low boiling point as compared with the dispersoid 61 containing a resin (or a precursor thereof). Therefore, the above-described bubble is preferentially generated in the dispersion medium 62 in microscopic view. That is, the change in volume of the bubble mainly accompanies the liquid/gas phase transition of the dispersion medium 62.

Accordingly, as compared with the case where the ejection solution is a liquid in which a resin is substantially uniformly dissolved, the volume of bubble can be changed at a lower temperature and the dispersion can be ejected with good efficiency.

Also, as compared with the case where the ejection solution is a liquid in which a resin is substantially uniformly dissolved, the change in volume of the bubble shows good conforming ability (the response speed becomes high) upon generation of heat energy and, therefore, the ejection interval of the dispersion 6 can be shortened, as a result, the productivity of toner is elevated.

In addition, as compared with the case where the ejection solution is a liquid in which a resin is substantially uniformly dissolved, the segmentation is facilitated for the viscosity of the solution as a whole because although the average viscosity of the dispersion as a whole is high, the local viscosity is almost equal to the viscosity of the dispersion medium. Therefore, the solid concentration can be made relatively high. Furthermore, even when the area of the ejection portion 23B is made small, since the liquid droplet is sharply divided, troubles such as clogging are scarcely brought about and a finer toner particle 9 can be relatively easily obtained.

The above-described bubble is mainly generated in the dispersion medium 62 and this can prevent the generated heat energy from being imparted directly to the dispersoid 61, so that the heat history given on the constituent material of the finally obtained toner particle 9 as a whole can be reduced. As a result, the toner less deteriorates due to heat and can have higher reliability.

Accompanying the generation of the bubble, at least a part of the dispersion medium 62 in the dispersion 6 may be removed by vaporization. By this removal, the amount of the dispersion medium 62 removed in the solidification unit 3 which is described later can be reduced and the production efficiency of toner can be more elevated.

In the toner producing apparatus 1B of the present invention, the generation cycle of heat energy from the heating element, the opening area (nozzle diameter) of the ejection portion, the temperature·viscosity of dispersion, the ejection amount in one droplet portion of dispersion, the content of the dispersoid occupying in the dispersion, the particle size of the dispersoid in the dispersion, and the like can be relatively precisely controlled. Also, the toner to be produced can be easily controlled to have desired shape and size. Furthermore, by controlling these conditions, for example, the production amount of toner can be easily and surely controlled.

In the toner producing apparatus 1B of the present invention, heat energy generated from a heating element is used and, therefore, by controlling the generation cycle or the like of heat energy, the dispersion can be ejected at predetermined intervals, so that the particulate dispersion ejected can be effectively prevented from colliding or aggregating with each other. As a result, as compared with the case of using a conventional spray dry method, a powder or the like of anomaly shapes is scarcely formed.

The heat energy may be generated by any method but is preferably generated by applying an alternating voltage to the heating element 22B. When the heat energy is generated by the application of an alternating voltage, the generation cycle of the bubble 213 and the ratio of change in volume of the bubble 213 with time can be easily and precisely controlled, as a result, the production amount of the toner or the size or the like of the toner particle 9 can be precisely controlled.

In the case of generating heat energy by the application of an alternating voltage, the frequency of the alternating voltage applied to the heating element 22B is not particularly limited but is preferably from 1 to 50 kHz, more preferably from 5 to 30 kHz. If the frequency of the alternating voltage is less than this lower limit, the productivity of toner decreases, whereas if the frequency of the alternating voltage exceeds the above-described upper limit, the ejection of the particulate dispersion 6 cannot keep pace with the frequency and the size in one droplet portion of the dispersion 6 varies widely.

In the present invention, the initial speed of the dispersion 6 ejected from the head unit 2 (2A, 2B) to the solidification unit 3 is, for example, preferably from 0.1 to 10 m/sec, more preferably from 2 to 8 m/sec. If the initial speed of the dispersion 6 is less than this lower limit, the productivity of toner decreases, whereas if the initial speed of the dispersion 6 exceeds the above-described upper limit, the obtained toner particle 9 is liable to decrease in the sphericity.

The viscosity of the dispersion 6 ejected from the head unit 2 (2A, 2B) is not particularly limited but this is, for example, preferably from 5 to 3,000 cps, more preferably from 10 to 1,000 cps. If the viscosity of the dispersion 6 is less than this lower limit, the size of the particle (particulate dispersion 6) ejected can be hardly controlled and the obtained toner particle 9 may vary widely. On the other hand, if the viscosity of the dispersion 6 exceeds the above-described upper limit, referring to the toner producing apparatus 1A of the invention, this causes a tendency that the size of the particle formed becomes large, the ejection speed of the dispersion 6 becomes low, and the energy amount necessary for the ejection of the dispersion 6 becomes large. In the case where the viscosity of the dispersion 6 is excessively high, the dispersion 6 cannot be ejected as a liquid droplet. Referring to the toner producing apparatus 1B of the invention, if the viscosity of the dispersion 6 exceeds the above-described upper limit, a so-called empty jetting phenomenon that the bubble is ejected in preference to the dispersion 6 to be ejected readily occurs and it becomes difficult to control the size or shape of the obtained toner particle and the production amount of the toner.

The dispersion 6 ejected from the head unit 2 may be previously heated. By thus heating the dispersion 6, for example, even when the dispersoid 61 is a material that takes a solid state (or in a relatively high viscosity state) at room temperature, it is possible to change the dispersoid into a melted state (or a relatively low viscosity state) at the ejection. As a result, the aggregation (fusion) of dispersoid 61 contained in the particulate dispersion 6 proceeds smoothly in the solidification unit 3 which is described later, and the obtained toner particle can be particularly high in the circularity.

The ejection amount in one droplet portion of the dispersion 6 slightly varies depending on the content or the like of the dispersoid 61 occupying in the dispersion but this is preferably from 0.05 to 500 pl, more preferably from 0.5 to 5 pl. By setting the ejection amount in one droplet portion of the dispersion 6 to a value falling in this range, the toner particle 9 can be made to have a proper particle size.

In general, the particulate dispersion 6 ejected from the head unit is sufficiently large as compared with the dispersoid 61 in the dispersion 6. That is, a large number of dispersoids 61 are dispersed in a particulate dispersion 6. Therefore, even when the particle size of dispersoid is relatively widely varied, fluctuation in the particle size of toner particle 9 can be reduced by ejecting the dispersion 6 in an almost uniform amount. This tendency is more outstanding. For example, when the average particle size of the ejected dispersion 6 is designated as Dd (μm) and the average particle size of the dispersoid 61 in the dispersion is designated as Dm (μm), they preferably satisfy the relationship of $Dm/Dd<0.5$, more preferably $Dm/Dd<0.2$.

Furthermore, when the average particle size of the dispersion 6 ejected is designated as Dd (μm) and the average particle size of the toner particle produced is designated as Dt (μm), they preferably satisfy the relationship of $0.05 \leqq Dt/Dd \leqq 1.0$, more preferably $0.1 \leqq Dt/Dd \leqq 0.8$. By satisfying these relationships, a toner particle 9 which is satisfactorily fine, high in the circularity and sharp in the particle size distribution can be relatively easily obtained.

Referring to the toner producing apparatus 1A of the invention, the frequency of the piezoelectric device 22A is not particularly limited but this is preferably from 10 kHz to 500 MHz, more preferably from 20 kHz to 200 MHz. If the frequency of the piezoelectric device 22A is less than this lower limit, the productivity of toner decreases, whereas if the frequency of the piezoelectric device 22A exceeds the above-described upper limit, the ejection of the particulate dispersion 6 cannot keep pace with the frequency and the size in one droplet portion of the dispersion 6 may vary widely.

The apparatus 1 (1A, 1B) for producing a toner having a constitution shown in the Figure has a plurality of head units 2 (2A, 2B) . From each of these head units, a particulate dispersion 6 is ejected into the solidification unit 3.

These head units 2 may eject the dispersion 6 almost at the same time but at least two adjacent head units are preferably controlled to differ in the timing of ejecting the dispersion 6. By such a control, the particulate dispersions 6 ejected from two adjacent head units can be more effectively prevented from colliding or aggregating before the particulate dispersion is solidified.

Furthermore, the apparatus 1 for producing a toner has a gas stream feed member 10 and is constituted such that a gas fed from the gas stream feed member 10 is jetted out from each gas jetting port 7 provided between a head unit 2 and a head unit 2 through a duct 101 under an almost uniform pressure. By such a constitution, the dispersion 6 can be transported and solidified while keeping the distance between particulate dispersions 6 intermittently ejected from ejection portions 23 (23A, 23B). As a result, the particulate dispersions 6 ejected can be more effectively prevented from colliding or aggregating with each other.

Also, a gas fed from the gas stream feed member 10 is jetted out from the gas jetting port 7, whereby a gas stream flowing substantially in one direction (downward direction in FIGS. 1, 2 and 8) is formed in the solidification unit 3. When such a gas stream is formed, the particulate dispersion 6 (toner particle 9) in the solidification unit 3 can be more efficiently transported.

In addition, when a gas is jetted out from the gas jetting port 7, an air flow curtain is formed between particles ejected from respective head units 2 and, for example, collision or aggregation between particles ejected from adjacent head units can be more effectively prevented.

The gas stream feed member 10 is equipped with a heat exchanger 11, whereby the temperature of the gas jetted out from the gas jetting port can be set to a preferred value and the particulate dispersion 6 ejected into the solidification unit 3 can be solidified with good efficiency.

Furthermore, when such a gas stream feed member 10 is provided, the solidification speed or the like of the dispersion 6 ejected from the ejection portion 23 (23A, 23B) can be easily controlled by adjusting the feed rate of gas stream.

The temperature of the gas jetted out from the gas jetting port 7 varies depending on the composition or the like of the dispersoid 61 or dispersion medium 62 contained in the dispersion 6 but usually, this temperature is preferably from 100 to 250° C., more preferably from 150 to 200° C. When the temperature of the gas jetted out from the gas jetting port 7 is within this range, the dispersion medium 62 contained in the dispersion 6 can be removed with good efficiency while keeping the uniformity in the shape of the toner particle 9 obtained, and particularly excellent productivity of toner can be attained.

The humidity of the gas jetted out from the gas jetting port 7 is, for example, preferably 50% RH or less, more preferably 30% RH or less, still more preferably 20% RH or less. When the humidity of the gas jetted out from the gas jetting port 7 is 50% RH or less, the dispersion medium 62 contained in the dispersion 6 can be removed with good efficiency in the solidification unit 3 which is described later, and the productivity of toner is more enhanced.

The particulate dispersion 6 ejected from the head unit 2 is solidified during the transportation in the solidification unit 3 and thereby formed into a toner particle 9.

The toner particle 9 is obtained, for example, by removing the dispersion medium 62 from the particulate dispersion 6 ejected. In this case, along the removal of dispersion medium 62 in the ejected dispersion 6, dispersoids 61 contained in the dispersion aggregate. As a result, the toner particle 9 is obtained as an aggregate of dispersoids 61. In the case where the above-described solvent is contained in the dispersoid 61, this solvent is also usually removed in the solidification unit 3 in the case of the toner producing apparatus 1A of the invention. On the other hand, in the case of the toner producing apparatus 1B of the invention, the solvent contained in the dispersoid 61 may be those which are removed, for example, in the solidification unit 3 or may be those which are removed due to the heat generated from the heating element 22.

Usually, the particle size of the dispersoid 61 contained in the dispersion 6 is sufficiently small as compared with the toner particle 9 (ejected particulate dispersion 6) obtained. Accordingly, the toner particle 9 obtained as an aggregate of dispersoids 61 has a sufficiently high circularity.

In the case of obtaining a toner particle 9 by removing the dispersion medium 61, the toner particle 6 obtained is usually small as compared with the dispersion 6 ejected from the ejection portion 23 (23A, 23B). Therefore, even when the area (opening area) of the ejection portion 23 (23A, 23B) is relatively large, the obtained toner particle 9 can be made to have a relatively small size. Accordingly, in the present invention, even when the head unit 2 is not produced through a special precision working (that is, which can be relatively easily produced), a sufficiently fine toner particle 9 can be obtained.

Furthermore, as described above, the area of the ejection portion 23 (23A, 23B) need not be made extremely small in the present invention and, therefore, the dispersion 6 ejected from respective head units 2 can be relatively easily made to have a sufficiently sharp particle size distribution. As a result, the toner particle 9 is less varied in the particle size, namely, the particle size distribution thereof is sharp.

As illustrated above, in the present invention, a dispersion is used as the ejection solution, so that even when the particle size of the produced toner particle 9 is sufficiently small, high circularity and sharp particle size distribution can be easily obtained. By virtue of these properties, the obtained toner can be uniform in the electric charge among particles and when the toner is used for printing, the toner thin layer formed on a development roller can be leveled in a high density. As a result, defects such as fogging are scarcely caused and a sharper image can be formed. Furthermore, the shape and particle size of the toner particle 9 are uniform and, therefore, the bulk density of the toner as a whole (the collective entity of toner particles 9) can be made large. This is advantageous in increasing the amount of toner filled in a cartridge without changing the volume of cartridge or downsizing the cartridge.

The solidification unit 3 is constituted by a cylindrical housing 31.

In the production of a toner, the inside of the housing 31 is preferably kept at a temperature within a predetermined range. By keeping the temperature as such, fluctuation in the properties among toner particles 9 due to the difference in the production conditions can be reduced and the toner as a whole can be elevated in the reliability.

For the purpose of keeping the temperature inside the housing 31 within a predetermined range, for example, a heat source or cooling source may be disposed in the inner side or outer side of the housing 31, or the housing 31 may be produced as a jacket having formed therein a flow path for a heating or cooling medium.

In the constitution shown in the Figure, the pressure inside the housing 31 is adjusted by a pressure adjusting member 12. By adjusting the pressure inside the housing 31 as such, the dispersion medium 62 in the dispersion 6 ejected can be efficiently removed and the productivity of toner is improved. In the constitution shown, the pressure adjusting member 12 is connected to the housing 31 through a connection pipe 121. In the vicinity of the end where the connection pipe 121 is connected to the housing 31, a diameter enlarging portion 122 enlarged in the inner diameter is formed and a filter 123 for preventing the suction of toner particle 9 or the like is further provided.

The pressure inside the housing 31 is not particularly limited but this is preferably 0.15 MPa or less, more preferably from 0.005 to 0.15 MPa, still more preferably from 0.109 to 0.110 MPa.

In the description above, it is stated that the dispersion medium 62 is removed from the dispersion 6 in the solidification unit, whereby dispersoids 61 in the particulate dispersions 6 are aggregated (fused) and a toner particle 9 is obtained. However, the method for obtaining a toner particle is not limited thereto. For example, in the case where a precursor of a resin material (such as a monomer, a dimer or an oligomer corresponding to the resin material) is contained in the dispersoid 61, the toner particle 9 may be obtained by a method of performing a polymerization reaction in the solidification unit.

The housing 31 is also connected with a voltage applying member 8 for applying a voltage. The voltage applying member 8 applies a voltage having the same polarity with the particulate dispersion 6 (toner particle 9) to the inner surface side of the housing 31, whereby the following effects are obtained.

Usually, the toner particle is charged positive or negative. Therefore, when an electrically charged material having a polarity different from the toner particle is present, a phenomenon that the toner particle is electro-statically attracted and attached to the electrically charged material occurs. On the other hand, when an electrically charged material having the same polarity with the toner particle is present, the electrically charged material and the toner particle repulse from each other and the above-described phenomenon that the toner is attached to the electrically charged material can be effectively prevented. Therefore, by applying a voltage having the same polarity with the particulate dispersion 6 (toner particle 9) to the inner surface side of the housing 31, the dispersion 6 (toner particle 9) can be effectively prevented from attaching to the inner surface of the housing 31. As a result, the generation of toner powder of anomaly shapes can be more effectively prevented and at the same time, the recovery efficiency of the toner particle 9 can be elevated.

The housing 31 has, in the vicinity of a recovery unit 5, a diameter reducing portion 311 reduced in the inner diameter toward the lower direction in FIG. 1. By forming such a diameter reducing portion 311, the toner particle 9 can be efficiently recovered. Incidentally, as described above, the dispersion 6 ejected from the ejection portion 23 is solidified in the solidification unit 3, however, this solidification is almost perfectly completed in the vicinity of the recovery unit 5 and even when respective particles come into contact with each other, troubles such as aggregation are scarcely generated in the vicinity of the diameter reducing portion 311.

The toner particle 9 obtained by solidifying the particulate dispersion 6 is recovered in the recovery unit 5.

The thus-obtained toner may be subjected, if desired, to various treatments such as classification and external addition.

For the classification treatment, for example, a sieve or an air classifier may be used.

Examples of the external additive for use in the external addition treatment include a fine particle constituted by an inorganic material such as metal oxide (e.g., silica, aluminum oxide, titanium oxide, strontium titanate, cerium oxide, magnesium oxide, chromium oxide, titania, zinc oxide, alumina, magnetite), nitride (e.g., silicon nitride), carbide (e.g., silicon carbide), calcium sulfate, calcium carbonate and aliphatic metal salt; a fine particle constituted by an organic material such as acrylic resin, fluororesin, polystyrene resin, polyester resin and aliphatic metal salt; and a fine particle constituted by a composite material thereof.

As the external additive, the above-described fine particle may be used after the surface thereof is treated with HMDS, a silane-base coupling agent, a titanate-base coupling agent, a fluorine-containing silane-base coupling agent, a silicone oil or the like.

The toner of the present invention produced as such has a uniform shape and the particle size distribution thereof is sharp (small in the width). Particularly, in the present invention, a toner particle having a shape close to a true sphere can be obtained.

More specifically, in the toner (toner particle), the average circularity R represented by the formula (I) shown below is preferably 0.95 or more, more preferably 0.96 or more, still more preferably 0.97 or more, and most preferably 0.98 or more. When the average circularity R is 0.95 or more, the transfer efficiency of toner is more enhanced.

$$R=L_0/L_1 \quad \text{(I)}$$

In formula (I), $L_1$ (μm) represents a circumferential length of a projected image of a toner particle to be measured and $L_0$ (μm) represents a circumferential length of a true circle (a geometrically complete circle) having the same area as the projected image of a toner particle to be measured.

Furthermore, in the toner, the standard deviation of average circularity among particles is preferably 0.02 or less, more preferably 0.015 or less, still more preferably 0.01 or less. When the standard deviation of average circularity among particles is 0.02 or less, the fluctuation particularly in the electric charging property, fixing property or the like is reduced and the toner as a whole is more elevated in the reliability.

The average particle size on the weight basis of toner obtained as above is preferably from 2 to 20 μm, more preferably from 4 to 10 μm. If the average particle size of toner is less than this lower limit, uniform electric charge can be hardly attained and adhesion to the surface of an electrostatic latent image carrier (for example, photoreceptor) increases, as a result, the residual toner which is not transferred may increase. On the other hand, if the average particle size of toner exceeds the above-described upper limit, the contour of an image formed using the toner, particularly, a letter image or a light pattern, is decreased in the reproducibility by development.

In the toner, the standard deviation of the particle size among particles is preferably 1.5 μm or less, more preferably 1.3 μm or less, still more preferably 1.0 μm or less. When the standard deviation of the particle size among particles is 1.5 μm or less, the fluctuation particularly in the electric charging property, fixing property or the like is reduced and the toner as a whole is more elevated in the reliability.

The second embodiment of the first toner producing apparatus 1A of the present invention is described below. This embodiment is described mainly by referring to the difference from the above-described embodiment and description of similar matters is omitted.

The toner producing apparatus according to this embodiment has the same constitution as the first embodiment except that the head unit has a different constitution.

Figure 3:
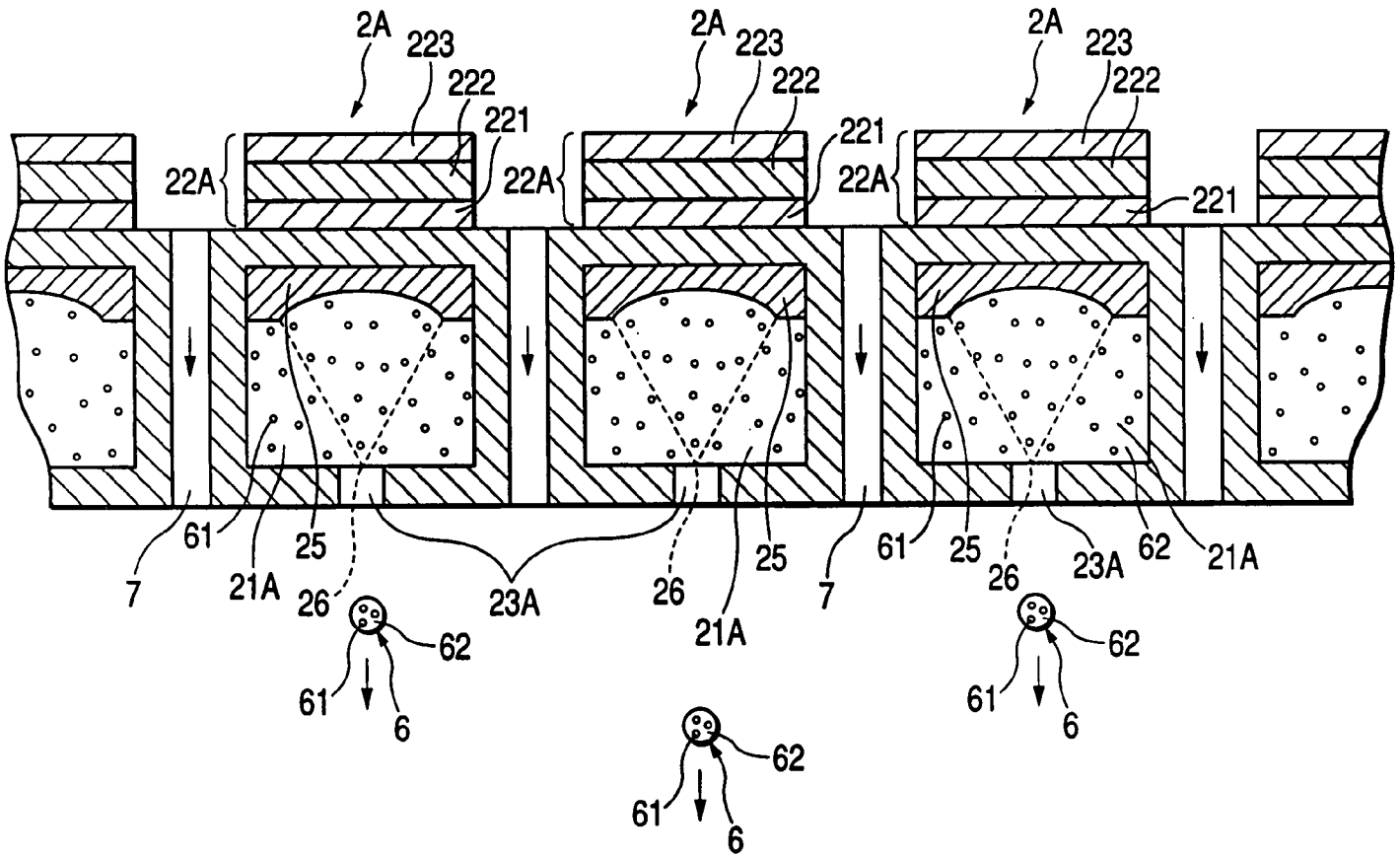
FIG. 3 is a view schematically showing the structure in the vicinity of the head unit of the second embodiment of toner producing apparatus 1A of the present invention.

FIG. 3 is a view schematically showing the structure in the vicinity of the head unit of the toner producing apparatus according to this embodiment.

As shown in FIG. 3, in the toner producing apparatus according to this embodiment, an acoustic lens (concave lens) 25 is provided in the head unit 2A. By providing such an acoustic lens 25, for example, the pressure pulse (vibration energy) generated from the piezoelectric device 22A can be converged at the pressure pulse converging portion 26 in the vicinity of the ejection portion 23A. As a result, the vibration energy generated from the piezoelectric device 22A can be efficiently utilized as an energy for ejecting the dispersion 6. Therefore, even when the dispersion 6 stored in the dispersion storing section 21A has a relatively high viscosity, the dispersion can be ejected from the ejection portion 23A without fail. Furthermore, even when the dispersion 6 stored in the dispersion storing section 21A has a relatively large cohesion (surface tension), the dispersion can be ejected as a fine liquid droplet and, therefore, the particle size of the toner particle 9 can be easily and unfailingly controlled to a relatively small value.

As such, in this embodiment, even when a material having a higher viscosity or a material having a large cohesion is used as the dispersion 6, the toner particle 9 can be controlled to a desired shape and a desired size. Therefore, the latitude particularly in the selection of a material is widened and a toner having desired properties can be more easily obtained.

Furthermore, in this embodiment, the dispersion 6 is ejected by a converged pressure pulse, so that even when the ejection portion 23A has a relatively large area (opening area), the size of the ejected dispersion 6 can be made relatively small. In other words, even when the toner particle 9 is intended to have a relatively small particle size, the area of the ejection portion 23A can be made large. As a result, even when the dispersion 6 has a relatively high viscosity, generation of clogging or the like in the ejection portion 23A can be more effectively prevented.

While the method for producing a toner, the toner and the apparatus for producing a toner of the present invention have been described by referring to suitable embodiments, however, the present invention is not limited thereto.

Figure 7:
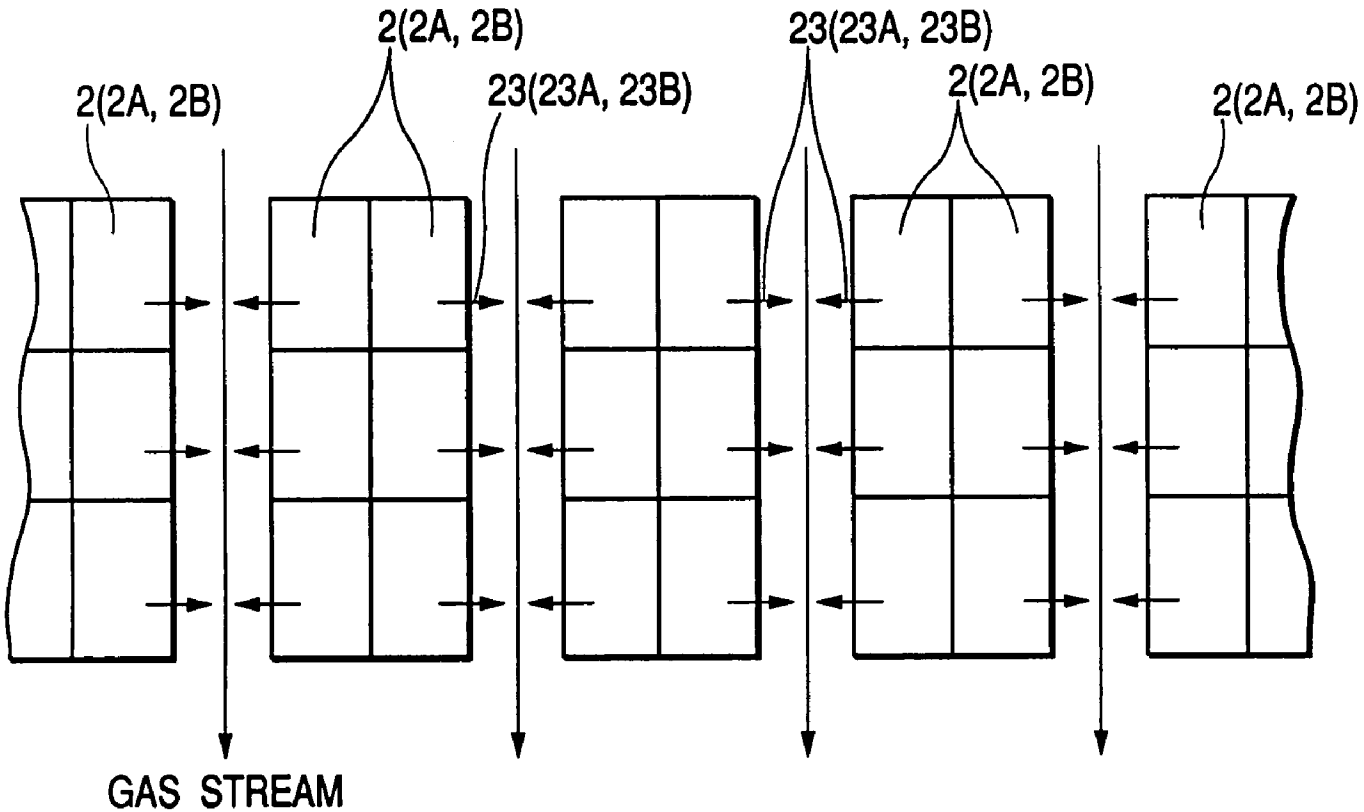
FIG. 7 is a view schematically showing the structure in the vicinity of the head unit of another embodiment of the toner producing apparatus of the present invention.

For example, each unit, section or portion constituting the apparatus for producing a toner of the present invention can be replaced by an arbitrary member capable of exerting the same function or other constitutions may be added. For example, in the above-described embodiments, a constitution of ejecting a particulate dispersion to the vertically downward direction is described above, however, the ejection direction of the dispersion may be any direction such as vertically upward direction or horizontal direction. Furthermore, as shown in FIG. 7, a constitution such that the ejection direction of the dispersion 6 meets substantially perpendicularly with the jetting direction of a gas jetted out from the gas jetting port 7 may also be employed. In this case, the particulate dispersion 6 ejected is rendered to change its traveling direction by the gas stream and transported substantially at a right angle with respect to the ejection direction from the ejection portion 23 (23A, 23B).

As for the second embodiment of the toner producing apparatus 1A, a constitution of using a concave lens as the acoustic lens is described above, however, the acoustic lens is not limited thereto. For example, a Fresnel lens or an electronic scanning lens may also be used as the acoustic lens.

Figure 4:
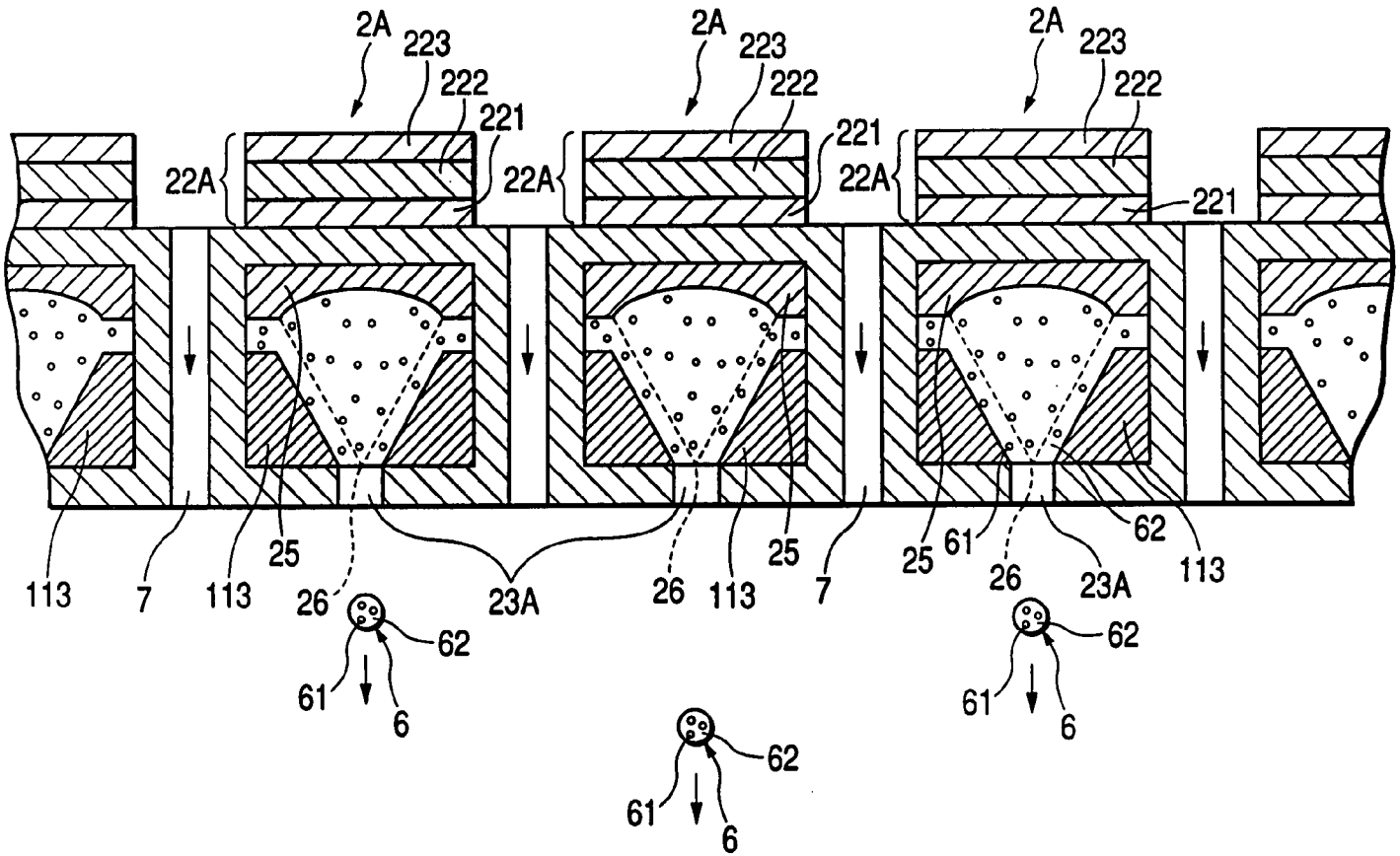
FIG. 4 is a view schematically showing the structure in the vicinity of the head unit of another embodiment of toner producing apparatus 1A of the present invention.
Figure 5:
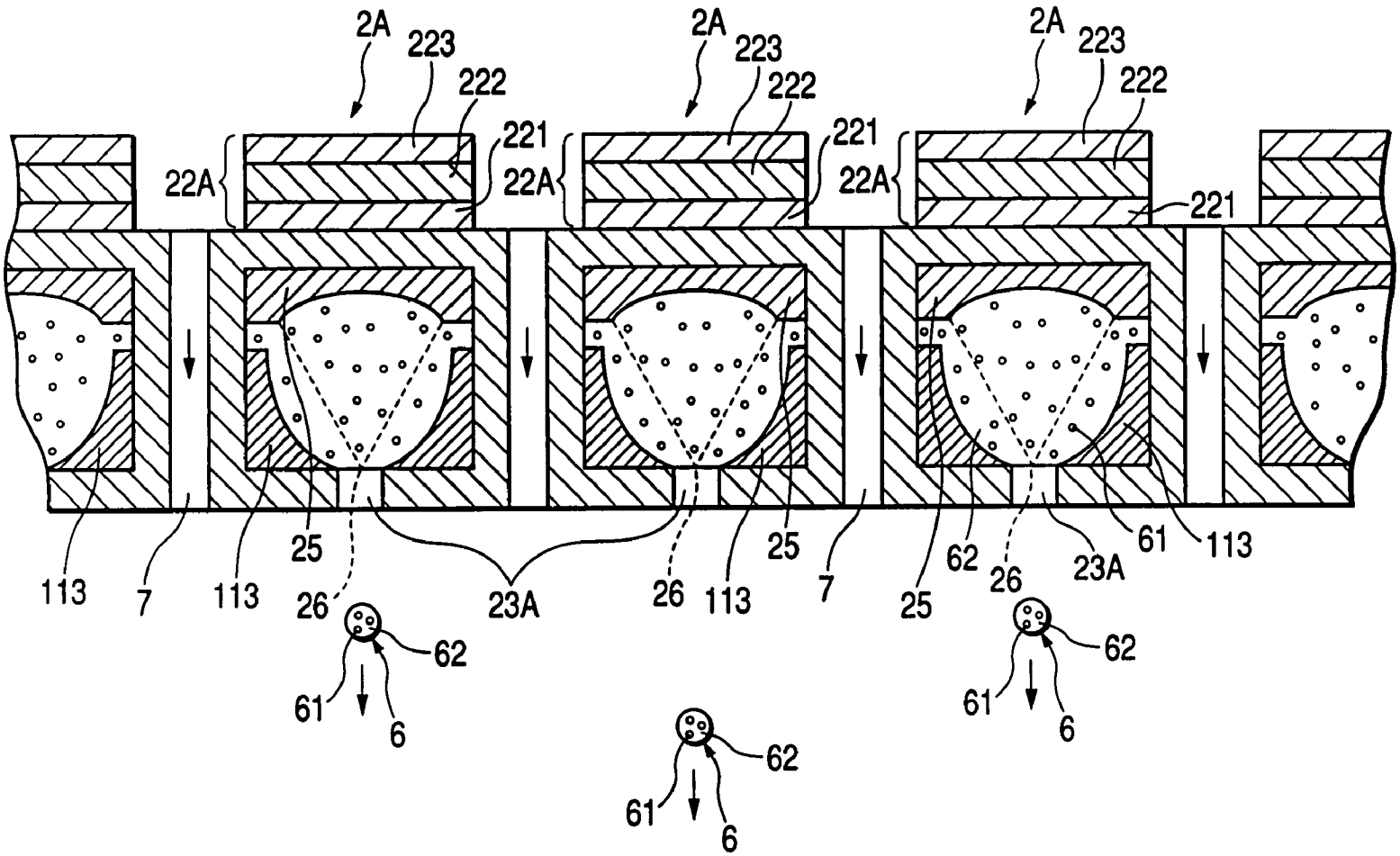
FIG. 5 is a view schematically showing the structure in the vicinity of the head unit of a still other embodiment of toner producing apparatus 1A of the present invention.
Figure 6:
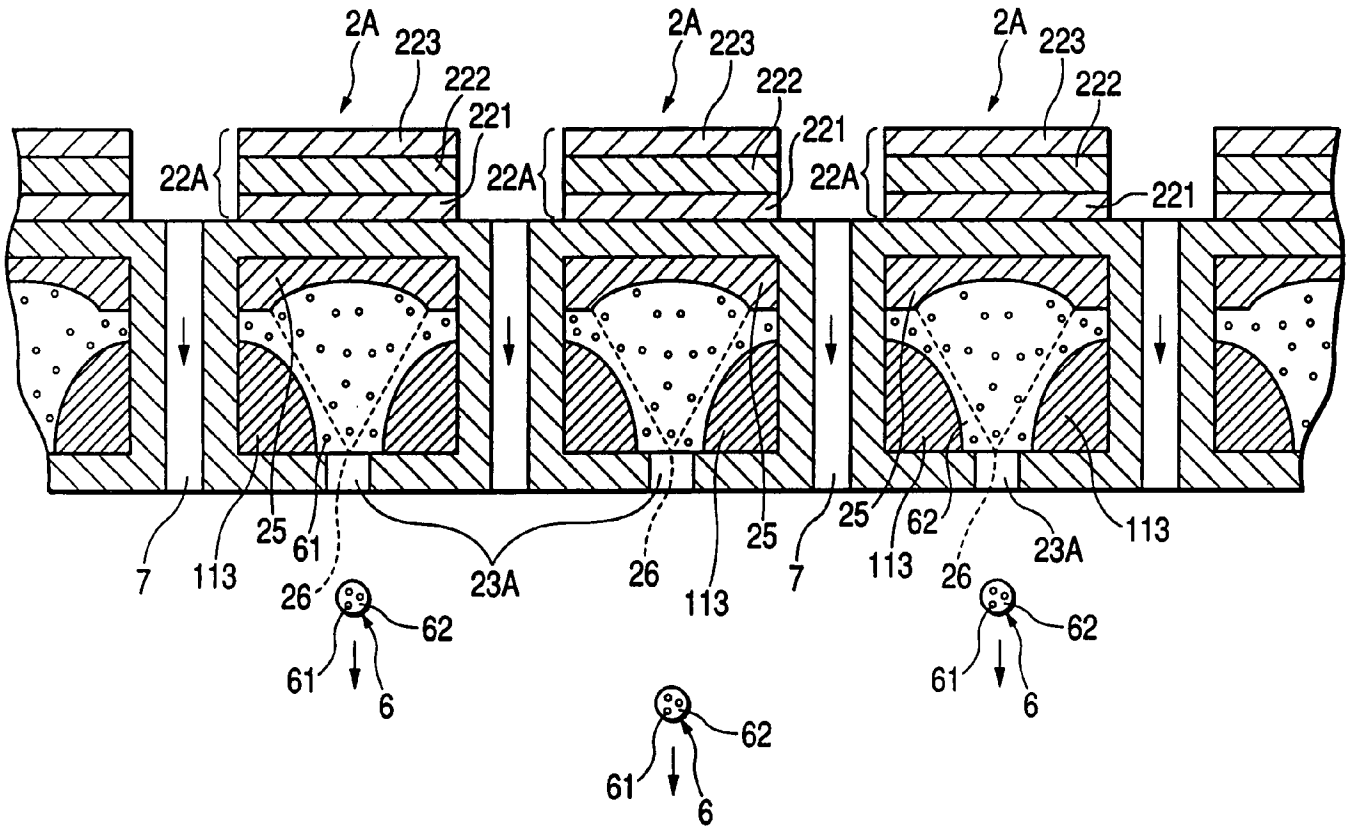
FIG. 6 is a view schematically showing the structure in the vicinity of the head unit of a still other embodiment of toner producing apparatus 1A of the present invention.

Furthermore, as for the second embodiment, a constitution where only a dispersion 6 is interposed between the acoustic lens 25 and the ejection portion 23A is described. However, as shown in FIGS. 4 to 6, a diaphragm member 113 or the like having a shape constringed toward the ejection portion 23A may be disposed between the acoustic lens 25 and the ejection portion 23A. This member can help the convergence of the pressure pulse (vibration energy) generated from the piezoelectric device 22A and, therefore, the pressure pulse generated from the piezoelectric device 22A can be more efficiently utilized.

EXAMPLES

The present invention will be illustrated in greater detail with reference to the following Examples and Comparative Examples, but the invention should not be construed as being limited thereto.

(1A) Production of Toner

Example 1A

In a 2 liter-volume stainless steel vessel with a round bottom, 800 ml of pure water, 30 g of a dispersant (sodium polyacrylate, average polymerization degree: 2,700 to 7,500, produced by Wako Pure Chemical Industries, Ltd.) and 0.5 g of a dispersion aid (sodium alkyldiphenyl ether disulfonate) were charged and they were thoroughly mixed to obtain a uniform solution (aqueous solution).

The obtained solution was stirred at a rotation number of 400 rpm using a TKL homomixer (manufactured by Tokushu Kika Kogyo Co., Ltd.) under heating. When the temperature of the solution reached 100° C., while controlling to keep an almost constant temperature, a mixture containing 200 g of a powdery polyester resin (Mn: 2,300, Mw: 8,700, Mw/Mn: 3.8, Tg: 62° C.), 12 g of a quinacridone-base pigment and 3 g of a charge control agent (BONTRON E-84, produced by Orient Chemical Industries, Ltd.) was poured in the solution little by little over about 10 minutes. The resulting solution was then stirred for 10 minutes.

Thereafter, the heating of the solution was stopped and the stirring was continued until the temperature of the solution after charging of the above-described mixture was lowered to room temperature, thereby obtaining a dispersion. The viscosity at 25° C. of the obtained dispersion was 185 cps and the average particle size Dm of the dispersoid in the obtained dispersion was 0.2 μm.

The thus-obtained dispersion was charged into the dispersion feed unit of an apparatus for producing a toner as shown in FIGS. 1 and 2. While stirring the dispersion in the dispersion feed unit with a stirring member, the dispersion was fed to the dispersion storing section of the head unit using a quantitative pump and ejected to the solidification unit from the ejection portion. The ejection portion had a circular shape with a diameter of 25 μm.

The ejection of the dispersion was performed in the state adjusted such that the dispersion temperature in the head unit was 25° C., the frequency of the piezoelectric body was 30 kHz, the initial speed of the dispersion ejected from the ejection portion was 4.2 m/sec and the ejection amount in one droplet portion of the dispersion ejected from the head unit was 2 pl (particle diameter Dd: 15.8 μm). Furthermore, the ejection of the dispersion was performed by differentiating the timing of ejecting the dispersion at least between adjacent head units out of a plurality of head units.

At the ejection of the dispersion, an air at a temperature of 190° C., a humidity of 27% RH and a flow rate of 4 m/sec was jetted to the vertically downward direction from the gas jetting ports and the pressure inside the housing was adjusted to 0.109 to 0.110 Pa. Also, a voltage was applied to the housing of the solidification unit to give a potential of −200 V in the inner surface side and thereby prevent the dispersion (toner particle) from adhering to the inner wall.

In the solidification unit, the dispersion medium was removed from the ejected dispersion and a particle as an aggregate of dispersoids was formed.

The particle formed in the solidification unit was recovered by a cyclone. The particles recovered had an average circularity R of 0.974 and the standard deviation of circularity was 0.012. The average particle size Dt on the weight basis was 6.4 μm and the standard deviation of particle size on the weight basis was 0.8. The measurement of circularity was performed in a water dispersion system using a flow-type particle image analyzer (FPIA-2000, manufactured by Toa Medical Electronics Co., Ltd.). Here, the circularity R is expressed by the following formula (I):

$$R=L_0/L_1 \quad \text{(I)}$$

wherein $L_1$ (μm) represents a circumferential length of a projected image of a particle to be measured and $L_0$ (μm) represents a circumferential length of a true circle having the same area as the projected image of a particle to be measured.

To 100 parts by weight of the obtained particle, 1.0 part by weight of hydrophobic silica was added to obtain a final toner. The average particle size on the weight basis of the finally obtained toner was 6.5 μm.

Example 2A

In a 2 liter-volume stainless steel vessel with a round bottom, 800 g of toluene, 200 g of a styrene-acryl copolymer (Mn: $7.13\times10^4$, Mw: $0.25\times10^4$, Mw/Mn: 27.0, Tg: 61.6° C.), 12 g of a phthalocyanine-base pigment and 3 g of a charge control agent (BONTRON E-84, produced by Orient Chemical Industries, Ltd.) were charged and mixed at room temperature for 30 minutes. Thereafter, they were further mixed at 60 Hz for 30 minutes using a motor mill (manufactured by EIGER JAPAN) to obtain a colored resin solution.

Separately, in a 2 liter-volume stainless steel vessel with a round bottom, 800 ml of pure water, 30 g of a dispersant (sodium polyacrylate, average polymerization degree: 2,700 to 7,500, produced by Wako Pure Chemical Industries, Ltd.) and 0.5 g of a dispersion aid (sodium alkyldiphenyl ether disulfonate) were charged and they were thoroughly mixed to obtain a uniform solution (aqueous solution).

The obtained aqueous solution was stirred at a rotation number of 400 rpm using a TKL homomixer (manufactured by Tokushu Kika Kogyo Co., Ltd.). To this solution under heating, the colored resin solution prepared above was added dropwise at a rate of 40 g/min. After the completion of dropwise addition, the solution was stirred for 10 minutes.

Thereafter, the aqueous solution after the dropwise addition of colored resin solution was heated at 55 to 58° C. and stirred at 400 rpm for 20 minutes in an atmosphere of 9 to 20 kPa to remove toluene and thereby obtain a dispersion. The viscosity at 25° C. of the obtained dispersion was 120 cps and the average particle size Dm of the dispersoid in the obtained dispersion was 0.27 μm.

The thus-obtained dispersion was charged into the dispersion feed unit of an apparatus for producing a toner as shown in FIGS. 1 and 2. While stirring the dispersion in the dispersion feed unit with a stirring member, the dispersion was fed to the dispersion storing section of the head unit using a quantitative pump and ejected to the solidification unit from the ejection portion. The ejection portion had a circular shape with a diameter of 25 μm.

The ejection of the dispersion was performed in the state adjusted such that the dispersion temperature in the head unit was 25° C., the frequency of the piezoelectric body was 30 kHz, the initial speed of the dispersion ejected from the ejection portion was 4.2 m/sec and the ejection amount in one droplet portion of the dispersion ejected from the head unit was 2 pl (particle diameter Dd: 15.8 μm). Furthermore, the ejection of the dispersion was performed by differentiating the timing of ejecting the dispersion at least between adjacent head units out of a plurality of head units.

At the ejection of the dispersion, an air at a temperature of 190° C., a humidity of 26% RH and a flow rate of 4 m/sec was jetted to the vertically downward direction from the gas jetting port and the pressure inside the housing was adjusted to 0.109 to 0.110 Pa. Also, a voltage was applied to the housing of the solidification unit to give a potential of −200 V in the inner surface side and thereby prevent the dispersion (toner particle) from adhering to the inner wall.

The dispersion medium was removed from the ejected dispersion in the solidification unit and a particle as an aggregate of dispersoids was formed.

The particle formed in the solidification unit was recovered by a cyclone. The particles recovered had an average circularity R of 0.976 and the standard deviation of circularity was 0.011. The average particle size Dt on the weight basis was 6.3 μm and the standard deviation of particle size on the weight basis was 0.6.

To 100 parts by weight of the obtained particle, 1.0 part by weight of hydrophobic silica was added to obtain a final toner. The average particle size on the weight basis of the finally obtained toner was 6.4 μm.

Example 3A

The dispersion used in Example 2A was prepared in the same manner as above and to this dispersion, 200 ml of ethanol was added and thoroughly stirred and mixed to obtain a dispersion for the production of a toner. The viscosity at 25° C. of the obtained dispersion was 104 cps and the average particle size Dm of the dispersoid in the obtained dispersion was 0.21 μm.

The thus-obtained dispersion was charged into the dispersion feed unit of an apparatus for producing a toner as shown in FIGS. 1 and 2. While stirring the dispersion in the dispersion feed unit with a stirring member, the dispersion was fed to the dispersion storing section of the head unit using a quantitative pump and ejected to the solidification unit from the ejection portion. The ejection portion had a circular shape with a diameter of 25 μm. Incidentally, the temperature of the dispersion in the dispersion feed unit was adjusted to 25° C.

The ejection of the dispersion was performed in the state adjusted such that the dispersion temperature in the head unit was 25° C., the frequency of the piezoelectric body was 30 kHz, the initial speed of the dispersion ejected from the ejection portion was 4.4 m/sec and the ejection amount in one droplet portion of the dispersion ejected from the head unit was 0.5 pl (particle diameter Dd: 10.0 μm). Furthermore, the ejection of the dispersion was performed by differentiating the timing of ejecting the dispersion at least between adjacent head units out of a plurality of head units.

At the ejection of the dispersion, an air at a temperature of 170° C., a humidity of 28% RH and a flow rate of 4 m/sec was jetted to the vertically downward direction from the gas jetting port and the pressure inside the housing was adjusted to 0.109 to 0.110 Pa. Also, a voltage was applied to the housing of the solidification unit to give a potential of −200 V in the inner surface side and thereby prevent the dispersion (toner particle) from adhering to the inner wall.

The dispersion medium was removed from the ejected dispersion in the solidification unit and a particle as an aggregate of dispersoids was formed.

The particle formed in the solidification unit was recovered by a cyclone. The particles recovered had an average circularity R of 0.987 and the standard deviation of circularity was 0.007. The average particle size Dt on the weight basis was 6.1 μm and the standard deviation of particle size on the weight basis was 0.5.

To 100 parts by weight of the obtained particle, 1.0 part by weight of hydrophobic silica was added to obtain a final toner. The average particle size on the weight basis of the finally obtained toner was 6.2 μm.

Examples 4A to 7A

Toners were produced in the same manner as in Example 1 except that the constitution in the vicinity of the head unit of an apparatus for producing a toner was changed as shown in FIGS. 3 to 6, respectively.

Comparative Example 1A

100 Parts by weight of a polyolefin resin (Tg: 60.2° C., flow tester softening temperature: 104° C.), 6 parts by weight of a phthalocyanine-base pigment and 1.5 parts by weight of a charge control agent (BONTRON E-84, produced by Orient Chemical Industries, Ltd.) were mixed and stirred in the heat-melted state at 120° C. to obtain a colored resin melt.

The obtained melt was charged into the dispersion feed unit of an apparatus for producing a toner as shown in FIGS. 1 and 2. The melt in the dispersion feed unit was fed to the dispersion storing section of the head unit using a quantitative pump and ejected to the solidification unit from the ejection portion. The ejection portion had a circular shape with a diameter of 25 μm. At this time, the temperature was kept at 120° C. in both the dispersion feed unit and the dispersion storing section.

The ejection of the melt was performed in the state adjusted such that the frequency of the piezoelectric body was 30 kHz, the initial speed of the melt ejected from the ejection portion was 4.2 m/sec and the ejection amount in one droplet portion of the melt ejected from the head unit was 0.5 pl (particle diameter Dd: 9.9 μm). Furthermore, the ejection of the melt was performed by differentiating the timing of ejecting the melt at least between adjacent head units out of a plurality of head units.

At the ejection of the dispersion, an air at a temperature of 25° C., a humidity of 45% RH and a flow rate of 4 m/sec was jetted to the vertically downward direction from the gas jetting port and the pressure inside the housing was adjusted to 0.109 to 0.11 MPa. Also, a voltage was applied to the housing of the solidification unit to give a potential of −200 V in the inner surface side and thereby prevent the melt (toner particle) from adhering to the inner wall.

The particle formed by the cooling and solidification of the melt in the solidification unit was recovered by a cyclone. The particles recovered had an average circularity R of 0.951 and the standard deviation of circularity was 0.078. The average particle size Dt on the weight basis was 10.2 μm and the standard deviation of particle size on the weight basis was 2.7.

To 100 parts by weight of the obtained particle, 1.0 part by weight of hydrophobic silica was added to obtain a final toner. The average particle size on the weight basis of the finally obtained toner was 10.3 μm.

Comparative Example 2A

In a 2 liter-volume stainless steel vessel with a round bottom, 800 g of toluene, 200 g of a styrene-acryl copolymer (Mn: $7.13\times10^4$, Mw: $0.25\times10^4$, Mw/Mn: 27.0, Tg: 61.6° C.), 12 g of a phthalocyanine-base pigment and 3 g of a charge control agent (BONTRON E-84, produced by Orient Chemical Industries, Ltd.) were charged and mixed at room temperature for 30 minutes. Thereafter, they were further mixed at 60 Hz for 30 minutes using a motor mill (manufactured by EIGER JAPAN) to obtain a colored resin solution.

Separately, in a 2 liter-volume stainless steel vessel with a round bottom, 800 ml of pure water, 30 g of a dispersant (sodium polyacrylate, average polymerization degree: 2,700 to 7,500, produced by Wako Pure Chemical Industries, Ltd.) and 0.5 g of a dispersion aid (sodium alkyldiphenyl ether disulfonate) were charged and they were thoroughly mixed to obtain a uniform solution (aqueous solution).

The obtained aqueous solution was stirred at a rotation number of 100 rpm using a TKL homomixer (manufactured by Tokushu Kika Kogyo Co., Ltd.). To this solution under heating, the colored resin solution prepared above was added dropwise at a rate of 60 g/min. After the completion of dropwise addition, the solution was stirred for 10 minutes.

Thereafter, the aqueous solution after the dropwise addition of colored resin solution was heated at 55 to 58° C. and stirred at 400 rpm for 20 minutes in an atmosphere of 9 to 20 kPa to remove toluene and thereby obtain a dispersion. The average particle size Dm of the dispersoid in the obtained dispersion was 7.8 μm.

The obtained dispersion was cooled and thereto, 2 liter of pure water was added. Subsequently, decantation of the resulting solution was performed twice in a 5 liter-volume beaker and furthermore, water washing (washing with pure water) and filtration were repeated 5 times at an ordinary temperature.

Then, an operation of adding the separated dispersoid to pure water at 50° C., stirring it for 1 hour and filtering the resulting solution was repeated twice.

The obtained filtrate (toner cake) was stirred and mixed in 1 liter of an aqueous 50 wt % methanol solution to obtain a uniform slurry. This slurry was dried in a spray drier (DISPACOAT, manufactured by Nisshin Engineering) to obtain a particulate material.

The obtained particulate material had an average circularity R of 0.975 and the standard deviation of circularity was 0.027. The average particle size Dt on the weight basis was 7.7 μm and the standard deviation of particle size on the weight basis was 2.1.

To 100 parts by weight of the obtained particulate material, 1.0 part by weight of hydrophobic silica was added to obtain a final toner. The average particle size on the weight basis of the finally obtained toner was 7.7 μm.

For the foregoing Examples and Comparative Examples, the average circularity R, the standard deviation of circularity, the average particle size Dt on the weight basis and the standard deviation of particle size, of the toner produced using the toner producing apparatus (i.e., toner particle before the addition of silica) and the average particle size of the finally obtained toner are summarized and shown in Table 1A together with the conditions of the dispersion used for the toner production.

TABLE 1A

| | Dispersion | | Toner Particle (Before Addition of Silica) | | | | |
|---|---|---|---|---|---|---|---|
| | Average Particle Size of Dispersoid, Dm (μm) | Average Particle Size of Dispersion, Dd (μm) | Average Circularity | Standard Deviation of Circularity | Average Particle Size, Dt (μm) | Standard Deviation of Particle Size | Average Particle Size of Toner (After Addition of Silica) (μm) |
| Example 1A | 0.20 | 15.8 | 0.974 | 0.012 | 6.4 | 0.8 | 6.5 |
| Example 2A | 0.27 | 15.8 | 0.976 | 0.011 | 6.3 | 0.6 | 6.4 |
| Example 3A | 0.21 | 10.0 | 0.987 | 0.007 | 6.1 | 0.5 | 6.2 |
| Example 4A | 0.21 | 15.5 | 0.967 | 0.015 | 7.2 | 1.4 | 7.2 |
| Example 5A | 0.20 | 14.8 | 0.982 | 0.010 | 6.6 | 0.7 | 6.7 |
| Example 6A | 0.19 | 15.2 | 0.978 | 0.014 | 7.1 | 0.6 | 7.2 |
| Example 7A | 0.20 | 14.6 | 0.986 | 0.007 | 6.3 | 0.5 | 6.4 |
| Comparative Example 1A | — | 9.9 | 0.951 | 0.078 | 10.2 | 2.7 | 10.2 |
| Comparative Example 2A | 0.25 | — | 0.975 | 0.027 | 7.7 | 2.1 | 7.8 |

As is apparent from Table 1A, the toners of Examples 1A to 7A had a high circularity and a small width in the particle size distribution.

On the other hand, the toner of Comparative Example 1A is low particularly in the circularity and a large number of toner particles having a relatively large protruded portion were observed. These results are considered to be ascribable to the following reasons.

That is, in Examples 1A to 7A, the raw material ejected from the head unit is an O/W emulsion (dispersion) and therefore, upon ejection from the head unit, the emulsion is selectively cut at the portion of dispersion medium microscopically having a low viscosity and ejected as an ejection solution. The aqueous dispersion has an appropriate surface tension and, therefore, the ejection solution swiftly forms a sphere after the ejection. On the other hand, in Comparative Example 1A, since the raw material used for the production has a uniform viscosity even in microscopic view, the liquid droplet is liable to form a tailed shape upon ejection from the head unit. Therefore, in Comparative Example 1A, a toner particle having a relatively large protruded portion is generated.

The toner of Comparative Example 2A was large particularly in the width of the particle size distribution.

(2A) Evaluation

The thus-obtained toners each was evaluated on the average electric charge/standard deviation of electric charge of toner particle, the bulk density, the storability, the durability and the transfer efficiency.

(2A.1) Average Electric Charge and Standard Deviation of Electric Charge of Toner Particle The toners produced in Examples and Comparative Examples each was measured on the average electrical charge and the standard deviation of electrical charge of the toner particle using E-SPART Analyzer (manufactured by Hosokawamicron Corporation). At the measurement, the temperature was 20° C. and the humidity was 58% RH.

(2A.2) Bulk Density

The toners produced in Examples and Comparative Examples each was measured on the bulk density using Powder Tester (manufactured by Hosokawamicron Corporation). At the measurement, the temperature was 20° C. and the humidity was 58% RH.

(2A.3) Storability

The toners produced in Examples and Comparative Examples each in 50 g was sampled in a Petri dish and left standing in an oven set at a temperature of 56 to 58° C. for 24 hours.

Thereafter, the heat generation from the heater of the oven was stopped and the toner was allowed to cool in the oven and further left standing for 24 hours. Then, the toner was taken out from the oven and passed through a sieve of 150 mesh. The weight of toner particle aggregates remaining on the sieve was measured and the residual ratio of aggregates was evaluated.

(2A.4) Durability

The toners obtained in Examples and Comparative Examples each was set in a developing machine of a color laser printer (LP-2000C, manufactured by Seiko Epson Corporation). Thereafter, the developing machine was continuously rotated without performing printing. After 12 hours, the developing machine was taken out and the uniformity of the toner thin layer on the developing roller was observed with an eye and evaluated according to the following 4-stage criteria:

A: Disorder was not observed at all on the thin layer.

B: Disorder was scarcely observed on the thin layer.

C: Disorder was slightly observed on the thin layer.

D: Streaky disorder was clearly observed on the thin layer.

(2A.5) Transfer Efficiency

The transfer efficiency of the toners produced in Examples and Comparative Examples was evaluated as follows using a color laser printer (LP-2000C, manufactured by Seiko Epson Corporation).

The toner on the photoreceptor immediately after the photoreceptor is subjected to development (before transfer) and the toner on the photoreceptor after transfer (after printing) were sampled using separate tapes and the weight of each toner was measured. When the toner weight on the photoreceptor before transfer is designated as $W_b$ (g) and the toner weight on the photoreceptor after transfer is designated as $W_a$ (g), the value obtained by $(W_b-W_a)\times 100/W_b$ is used as representing the transfer efficiency.

These results are shown together in Table 2A.

TABLE 2A

| | Average Electric Charge (μC/g) | Standard Deviation of Electric Charge | Bulk Density (g/cm$^3$) | Storability (%) | Durability | Transfer Efficiency (%) |
|---|---|---|---|---|---|---|
| Example 1A | −12.0 | 6.23 | 0.436 | 0.2 | A | 98.8 |
| Example 2A | −11.6 | 7.11 | 0.422 | 0.3 | A | 99.2 |
| Example 3A | −11.7 | 6.36 | 0.437 | 0.1 | A | 99.3 |
| Example 4A | −9.8 | 7.45 | 0.398 | 0.3 | B | 99.0 |
| Example 5A | −12.2 | 4.22 | 0.419 | 0.1 | A | 98.7 |
| Example 6A | −10.1 | 5.18 | 0.403 | 0.2 | B | 99.3 |
| Example 7A | −11.7 | 5.64 | 0.432 | 0.1 | A | 99.4 |
| Comparative Example 1A | −9.6 | 13.88 | 0.372 | 1.4 | C | 92.3 |
| Comparative Example 2A | −9.4 | 14.22 | 0.366 | 1.8 | D | 89.6 |

As is apparent from Table 2A, the toner of the present invention is small in the standard deviation of electric charge of the toner particle. In other words, fluctuation in the electric charge is small. From this, it is seen that in the toner of the present invention, the properties are less varied among particles.

Also, the toner of the present invention had a large bulk density. This reveals that the toner of the present invention is advantageous in more increasing the amount of toner filled in the cartridge without changing the volume of cartridge or downsizing the cartridge.

Furthermore, the toner of the present invention was excellent in the storability, durability and transfer efficiency.

On the other hand, the toner of Comparative Examples is varied widely in the electric charge and small in the bulk density. Furthermore, the toner of Comparative Examples was inferior in the storability, durability and transfer efficiency.

Incidentally, in the case of using a spray dry method, even when various conditions such as gas jetting pressure and raw material temperature are set to suitable values, the circularity of the obtained toner particle is usually about 0.97, the standard deviation of circularity is about 0.04 and the standard deviation of particle size is about 2.7 μm.

(1B) Production of Toner

Example 1B

In a 2 liter-volume stainless steel vessel with a round bottom, 800 ml of pure water, 30 g of a dispersant (sodium polyacrylate, average polymerization degree: 2,700 to 7,500, produced by Wako Pure Chemical Industries, Ltd.) and 0.5 g of a dispersion aid (sodium alkyldiphenyl ether disulfonate) were charged and they were thoroughly mixed to obtain a uniform solution (aqueous solution).

The obtained solution was stirred at a rotation number of 400 rpm using a TKL homomixer (manufactured by Tokushu Kika Kogyo Co., Ltd.) under heating. When the temperature of the solution reached 100° C., while controlling to keep an almost constant temperature, a mixture containing 200 g of a powdery polyester resin (Mn: 2,300, Mw: 8,700, Mw/Mn: 3.8, Tg: 62° C.), 12 g of a quinacridone-base pigment and 3 g of a charge control agent (BONTRON E-84, produced by Orient Chemical Industries, Ltd.) was poured in the solution little by little over about 10 minutes. The resulting solution was then stirred for 10 minutes.

Thereafter, the heating of the solution was stopped and the stirring was continued until the temperature of the solution after charging of the above-described mixture was lowered to room temperature, thereby obtaining a dispersion. The viscosity at 25° C. of the obtained dispersion was 180 cps and the average particle size Dm of the dispersoid in the obtained dispersion was 0.21 μm.

The thus-obtained dispersion was charged into the dispersion feed unit of an apparatus for producing a toner as shown in FIGS. 1 and 8. While stirring the dispersion in the dispersion feed unit with a stirring member, the dispersion was fed to the dispersion storing section of the head unit using a quantitative pump and ejected to the solidification unit from the ejection portion. The ejection portion had a circular shape with a diameter of 25 μm. Incidentally, the temperature of the dispersion in the dispersion feed unit was adjusted to 25° C.

The ejection of the dispersion was performed by applying a high-frequency alternating voltage of 20 kHz to the heating element to periodically change the volume of bubble generated in the dispersion storing section. The initial speed of the dispersion ejected from the ejection portion was 4.2 m/sec and the ejection amount in one droplet portion of the dispersion ejected from the head unit was 2 pl (particle diameter Dd: 15.8 μm). Furthermore, the ejection of the dispersion was performed by differentiating the timing of ejecting the dispersion at least between adjacent head units out of a plurality of head units.

At the ejection of the dispersion, an air at a temperature of 190° C., a humidity of 30% RH and a flow rate of 4 m/sec was jetted to the vertically downward direction from the gas jetting ports and the pressure inside the housing was adjusted to 0.109 to 0.110 Pa. Also, a voltage was applied to the housing of the solidification unit to give a potential of −200 V in the inner surface side and thereby prevent the dispersion (toner particle) from adhering to the inner wall.

In the solidification unit, the dispersion medium was removed from the ejected dispersion and a particle as an aggregate of dispersoids was formed.

The particle formed in the solidification unit was recovered by a cyclone. The particles recovered had an average circularity R of 0.964 and the standard deviation of circularity was 0.015. The average particle size Dt on the weight basis was 6.7 μm and the standard deviation of particle size on the weight basis was 1.2. The measurement of circularity was performed in a water dispersion system using a flow-type particle image analyzer (FPIA-2000, manufactured by Toa Medical Electronics Co., Ltd.). Here, the circularity R is expressed by the following formula (I):

$$R=L_0/L_1 \quad \text{(I)}$$

wherein $L_1$ (μm) represents a circumferential length of a projected image of a particle to be measured and $L_0$ (μm) represents a circumferential length of a true circle having the same area as the projected image of a particle to be measured.

To 100 parts by weight of the obtained particle, 1.0 part by weight of hydrophobic silica was added to obtain a final toner. The average particle size on the weight basis of the finally obtained toner was 6.8 μm.

Example 2B

In a 2 liter-volume stainless steel vessel with a round bottom, 800 g of toluene, 200 g of a styrene-acryl copolymer (Mn: $7.13\times10^4$, Mw: $0.25\times10^4$, Mw/Mn: 27.0, Tg: 61.6° C.), 12 g of a phthalocyanine-base pigment and 3 g of a charge control agent (BONTRON E-84, produced by Orient Chemical Industries, Ltd.) were charged and mixed at room temperature for 30 minutes. Thereafter, they were further mixed at 60 Hz for 30 minutes using a motor mill (manufactured by EIGER JAPAN) to obtain a colored resin solution.

Separately, in a 2 liter-volume stainless steel vessel with a round bottom, 800 ml of pure water, 30 g of a dispersant (sodium polyacrylate, average polymerization degree: 2,700 to 7,500, produced by Wako Pure Chemical Industries, Ltd.) and 0.5 g of a dispersion aid (sodium alkyldiphenyl ether disulfonate) were charged and they were thoroughly mixed to obtain a uniform solution (aqueous solution).

The obtained aqueous solution was stirred at a rotation number of 400 rpm using a TKL homomixer (manufactured by Tokushu Kika Kogyo Co., Ltd.). To this solution under heating, the colored resin solution prepared above was added dropwise at a rate of 40 g/min. After the completion of dropwise addition, the solution was stirred for 10 minutes.

Thereafter, the aqueous solution after the dropwise addition of colored resin solution was heated at 55 to 58° C. and stirred at 400 rpm for 20 minutes in an atmosphere of 9 to 20 kPa to remove toluene and thereby obtain a dispersion. The viscosity at 25° C. of the obtained dispersion was 119 cps and the average particle size Dm of the dispersoid in the obtained dispersion was 0.26 μm.

The thus-obtained dispersion was charged into the dispersion feed unit of an apparatus for producing a toner as shown in FIGS. 1 and 8. While stirring the dispersion in the dispersion feed unit with a stirring member, the dispersion was fed to the dispersion storing section of the head unit using a quantitative pump and ejected to the solidification unit from the ejection portion. The ejection portion had a circular shape with a diameter of 25 μm. Incidentally, the temperature of the dispersion in the dispersion feed unit was adjusted to 25° C.

The ejection of the dispersion was performed by applying a high-frequency alternating voltage of 20 kHz to the heating element to periodically change the volume of bubble generated in the dispersion storing section. The initial speed of the dispersion ejected from the ejection portion was 4.2 m/sec and the ejection amount in one droplet portion of the dispersion ejected from the head unit was 2 pl (particle diameter Dd: 15.8 μm). Furthermore, the ejection of the dispersion was performed by differentiating the timing of ejecting the dispersion at least between adjacent head units out of a plurality of head units.

At the ejection of the dispersion, an air at a temperature of 190° C., a humidity of 28% RH and a flow rate of 4 m/sec was jetted to the vertically downward direction from the gas jetting port and the pressure inside the housing was adjusted to 0.109 to 0.110 Pa. Also, a voltage was applied to the housing of the solidification unit to give a potential of −200 V in the inner surface side and thereby prevent the dispersion (toner particle) from adhering to the inner wall.

The dispersion medium was removed from the ejected dispersion in the solidification unit and a particle as an aggregate of dispersoids was formed.

The particle formed in the solidification unit was recovered by a cyclone. The particles recovered had an average circularity R of 0.967 and the standard deviation of circularity was 0.013. The average particle size Dt on the weight basis was 6.8 μm and the standard deviation of particle size on the weight basis was 1.3.

To 100 parts by weight of the obtained particle, 1.0 part by weight of hydrophobic silica was added to obtain a final toner. The average particle size on the weight basis of the finally obtained toner was 6.8 μm.

Example 3B

The dispersion used in Example 2B was prepared in the same manner as above and to this dispersion, 200 ml of ethanol was added and thoroughly stirred and mixed to obtain a dispersion for the production of a toner. The viscosity at 25° C. of the obtained dispersion was 104 cps and the average particle size Dm of the dispersoid in the obtained dispersion was 0.21 μm.

The thus-obtained dispersion was charged into the dispersion feed unit of an apparatus for producing a toner as shown in FIGS. 1 and 8. While stirring the dispersion in the dispersion feed unit with a stirring member, the dispersion was fed to the dispersion storing section of the head unit using a quantitative pump and ejected to the solidification unit from the ejection portion. The ejection portion had a circular shape with a diameter of 25 μm. Incidentally, the temperature of the dispersion in the dispersion feed unit was adjusted to 25° C.

The ejection of the dispersion was performed by applying a high-frequency alternating voltage of 20 kHz to the heating element to periodically change the volume of bubble generated in the dispersion storing section. The initial speed of the dispersion ejected from the ejection portion was 4.4 m/sec and the ejection amount in one droplet portion of the dispersion ejected from the head unit was 0.5 pl (particle diameter Dd: 10.0 μm). Furthermore, the ejection of the dispersion was performed by differentiating the timing of ejecting the dispersion at least between adjacent head units out of a plurality of head units.

At the ejection of the dispersion, an air at a temperature of 170° C., a humidity of 28% RH and a flow rate of 4 m/sec was jetted to the vertically downward direction from the gas jetting port and the pressure inside the housing was adjusted to 0.109 to 0.110 Pa. Also, a voltage was applied to the housing of the solidification unit to give a potential of −200 V in the inner surface side and thereby prevent the dispersion (toner particle) from adhering to the inner wall.

The dispersion medium was removed from the ejected dispersion in the solidification unit and a particle as an aggregate of dispersoids was formed.

The particle formed in the solidification unit was recovered by a cyclone. The particles recovered had an average circularity R of 0.971 and the standard deviation of circularity was 0.010. The average particle size Dt on the weight basis was 5.8 μm and the standard deviation of particle size on the weight basis was 0.9.

To 100 parts by weight of the obtained particle, 1.0 part by weight of hydrophobic silica was added to obtain a final toner. The average particle size on the weight basis of the finally obtained toner was 5.9 μm.

Comparative Example 1B

100 Parts by weight of a polyolefin resin (Tg: 60.2° C., flow tester softening temperature: 104° C.), 6 parts by weight of a phthalocyanine-base pigment and 1.5 parts by weight of a charge control agent (BONTRON E-84, produced by Orient Chemical Industries, Ltd.) were mixed and stirred in the heat-melted state at 120° C. to obtain a colored resin melt.

The obtained melt was charged into the dispersion feed unit of an apparatus for producing a toner as shown in FIGS. 1 and 8. The melt in the dispersion feed unit was fed to the dispersion storing section of the head unit using a quantitative pump and ejected to the solidification unit from the ejection portion. The ejection portion had a circular shape with a diameter of 25 μm. At this time, the temperature was adjusted at 120° C. in both the dispersion feed unit and the dispersion storing section.

The ejection of the melt was performed by applying a high-frequency alternating voltage of 20 kHz to the heating element to periodically change the volume of bubble generated in the dispersion storing section. The initial speed of the melt ejected from the ejection portion was 3.6 m/sec and the ejection amount in one droplet portion of the melt ejected from the head unit was 2.1 pl (particle diameter Dd: 15.9 μm). In addition, the viscosity of the melt ejected from the ejection portion was $1.3\times10^4$ cps (120° C.). Furthermore, the ejection of the melt was performed by differentiating the timing of ejecting the melt at least between adjacent head units out of a plurality of head units.

At the ejection of the dispersion, an air at a temperature of 14° C., a humidity of 35% RH and a flow rate of 4 m/sec was jetted to the vertically downward direction from the gas jetting port and the pressure inside the housing was adjusted to 0.109 to 0.110 MPa. Also, a voltage was applied to the housing of the solidification unit to give a potential of −200 V in the inner surface side and thereby prevent the melt (toner particle) from adhering to the inner wall.

The particle formed by the cooling and solidification of the melt in the solidification unit was recovered by a cyclone. The particles recovered had an average circularity R of 0.951 and the standard deviation of circularity was 0.078. The average particle size Dt on the weight basis was 10.2 μm and the standard deviation of particle size on the weight basis was 2.7.

To 100 parts by weight of the obtained particle, 1.0 part by weight of hydrophobic silica was added to obtain a final toner. The average particle size on the weight basis of the finally obtained toner was 10.3 μm.

Comparative Example 2B

In a 2 liter-volume stainless steel vessel with a round bottom, 800 g of toluene, 200 g of a styrene-acryl copolymer (Mn: $7.13\times10^4$, Mw: $0.25\times10^4$, Mw/Mn: 27.0, Tg: 61.6° C.), 12 g of a phthalocyanine-base pigment and 3 g of a charge control agent (BONTRON E-84, produced by Orient Chemical Industries, Ltd.) were charged and mixed at room temperature for 30 minutes. Thereafter, they were further mixed at 60 Hz for 30 minutes using a motor mill (manufactured by EIGER JAPAN) to obtain a colored resin solution.

Separately, in a 2 liter-volume stainless steel vessel with a round bottom, 800 ml of pure water, 30 g of a dispersant (sodium polyacrylate, average polymerization degree: 2,700 to 7,500, produced by Wako Pure Chemical Industries, Ltd.) and 0.5 g of a dispersion aid (sodium alkyldiphenyl ether disulfonate) were charged and they were thoroughly mixed to obtain a uniform solution (aqueous solution).

The obtained aqueous solution was stirred at a rotation number of 200 rpm using a TKL homomixer (manufactured by Tokushu Kika Kogyo Co., Ltd.). To this solution under heating, the colored resin solution prepared above was added dropwise at a rate of 60 g/min. After the completion of dropwise addition, the solution was stirred for 10 minutes.

Thereafter, the aqueous solution after the dropwise addition of colored resin solution was heated at 55 to 58° C. and stirred at 400 rpm for 20 minutes in an atmosphere of 9 to 20 kPa to remove toluene and thereby obtain a dispersion. The average particle size Dm of the dispersoid in the obtained dispersion was 6.9 μm.

The obtained dispersion was cooled and thereto, 2 liter of pure water was added. Subsequently, decantation of the resulting solution was performed twice in a 5 liter-volume beaker and furthermore, water washing (washing with pure water) and filtration were repeated 5 times at an ordinary temperature.

Then, an operation of adding the separated dispersoid to pure water at 50° C., stirring it for 1 hour and filtering the resulting solution was repeated twice.

The obtained filtrate (toner cake) was stirred and mixed in 1 liter of an aqueous 50 wt % methanol solution to obtain a uniform slurry. This slurry was dried in a spray drier (DISPACOAT, manufactured by Nisshin Engineering) to obtain a particulate material.

The obtained particulate material had an average circularity R of 0.964 and the standard deviation of circularity was 0.031. The average particle size Dt on the weight basis was 6.8 μm and the standard deviation of particle size on the weight basis was 2.1.

To 100 parts by weight of the obtained particulate material, 1.0 part by weight of hydrophobic silica was added to obtain a final toner. The average particle size on the weight basis of the finally obtained toner was 6.6 μm.

For the foregoing Examples and Comparative Examples, the average circularity R, the standard deviation of circularity, the average particle size Dt on the weight basis and the standard deviation of particle size, of the toner produced using the toner producing apparatus (i.e., toner particle before the addition of silica) and the average particle size of the finally obtained toner are summarized and shown in Table 1B together with the conditions of the dispersion used for the toner production.

TABLE 1B

| | Dispersion | | Toner Particle (Before Addition of Silica) | | | | |
|---|---|---|---|---|---|---|---|
| | Average Particle Size of Dispersoid, Dm (μm) | Average Particle Size of Dispersion, Dd (μm) | Average Circularity | Standard Deviation of Circularity | Average Particle Size, Dt (μm) | Standard Deviation of Particle Size | Average Particle Size of Toner (After Addition of Silica) (μm) |
| Example 1B | 0.21 | 15.8 | 0.964 | 0.015 | 6.7 | 1.2 | 6.8 |
| Example 2B | 0.26 | 15.8 | 0.967 | 0.013 | 6.8 | 1.3 | 6.8 |
| Example 3B | 0.21 | 10.0 | 0.971 | 0.010 | 5.8 | 0.9 | 5.9 |
| Comparative Example 1B | — | 15.9 | 0.951 | 0.078 | 10.2 | 2.7 | 10.3 |
| Comparative Example 2B | 6.9 | — | 0.965 | 0.031 | 6.8 | 2.1 | 6.6 |

As is apparent from Table 1B, the toners of Examples 1B to 3B had a high circularity and a small width in the particle size distribution. Particularly, in Example 3B, despite the relative low heating temperature in the solidification unit, the obtained toner has particularly a high circularity and a small width in the particle size distribution. This is considered to result because an azeotropic mixture was formed in the dispersion medium and the removal of the dispersion medium could be performed more efficiently.

On the other hand, the toner of Comparative Example 1B is low particularly in the circularity and a large number of toner particles having a relatively large protruded portion were observed. These results are considered to be ascribable to the following reasons.

That is, in Examples 1B to 3B, the raw material ejected from the head unit is an O/W emulsion (dispersion) and therefore, upon ejection from the head unit, the emulsion is selectively cut at the portion of dispersion medium microscopically having a low viscosity and ejected as an ejection solution. The aqueous dispersion has an appropriate surface tension and, therefore, the ejection solution swiftly forms a sphere after the ejection. On the other hand, in Comparative Example 1B, since the raw material used for the production has a uniform viscosity even in microscopic view and has high viscosity, the liquid droplet is liable to form a tailed shape upon ejection from the head unit. Therefore, in Comparative Example 1B, a toner particle having a relatively large protruded portion is generated.

The toner of Comparative Example 2B was large particularly in the width of the particle size distribution.

(2B) Evaluation

The thus-obtained toners each was evaluated on the average electric charge/standard deviation of electric charge of toner particle, the bulk density, the storability, the durability and the transfer efficiency.

(2B.1) Average Electric Charge and Standard Deviation of Electric Charge of Toner Particle The toners produced in Examples and Comparative Examples each was measured on the average electrical charge and the standard deviation of electrical charge of the toner particle using E-SPART Analyzer (manufactured by Hosokawamicron Corporation). At the measurement, the temperature was 20° C. and the humidity was 58% RH.

(2B.2) Bulk Density

The toners produced in Examples and Comparative Examples each was measured on the bulk density using Powder Tester (manufactured by Hosokawamicron Corporation). At the measurement, the temperature was 20° C. and the humidity was 58% RH.

(2B.3) Storability

The toners produced in Examples and Comparative Examples each in 50 g was sampled in a Petri dish and left standing in an oven set at a temperature of 56 to 58° C. for 24 hours.

Thereafter, the heat generation from the heater of the oven was stopped and the toner was allowed to cool in the oven and further left standing for 24 hours. Then, the toner was taken out from the oven and passed through a sieve of 150 mesh. The weight of toner particle aggregates remaining on the sieve was measured and the residual ratio of aggregates was evaluated.

(2B.4) Durability

The toners obtained in Examples and Comparative Examples each was set in a developing machine of a color laser printer (LP-2000C, manufactured by Seiko Epson Corporation). Thereafter, the developing machine was continuously rotated without performing printing. After 12 hours, the developing machine was taken out and the uniformity of the toner thin layer on the developing roller was observed with an eye and evaluated according to the following 4-stage criteria:

A: Disorder was not observed at all on the thin layer.

B: Disorder was scarcely observed on the thin layer.

C: Disorder was slightly observed on the thin layer.

D: Streaky disorder was clearly observed on the thin layer.

(2B.5) Transfer Efficiency

The transfer efficiency of the toners produced in Examples and Comparative Examples was evaluated as follows using a color laser printer (LP-2000C, manufactured by Seiko Epson Corporation).

The toner on the photoreceptor immediately after the photoreceptor is subjected to development (before transfer) and the toner on the photoreceptor after transfer (after printing) were sampled using separate tapes and the weight of each toner was measured. When the toner weight on the photoreceptor before transfer is designated as $W_b$ (g) and the toner weight on the photoreceptor after transfer is designated as $W_a$ (g), the value obtained by $(W_b-W_a)\times 100/W_b$ is used as representing the transfer efficiency.

These results are shown together in Table 2B.

TABLE 2B

| | Average Electric Charge (μC/g) | Standard Deviation of Electric Charge | Bulk Density (g/cm$^3$) | Storability (%) | Durability | Transfer Efficiency (%) |
|---|---|---|---|---|---|---|
| Example 1B | 14.8 | 6.12 | 0.436 | 0.2 | A | 98.4 |
| Example 2B | 13.2 | 5.37 | 0.422 | 0.3 | B | 97.8 |
| Example 3B | 11.7 | 6.36 | 0.437 | 0.1 | A | 99.3 |
| Comparative Example 1B | 10.8 | 13.21 | 0.372 | 0.1 | C | 93.3 |
| Comparative Example 2B | 11.4 | 14.05 | 0.373 | 1.7 | D | 92.7 |

As is apparent from Table 2B, the toner of the present invention is small in the standard deviation of electric charge of the toner particle. In other words, fluctuation in the electric charge is small. From this, it is seen that in the toner of the present invention, the properties are less varied among particles.

Also, the toner of the present invention had a large bulk density. This reveals that the toner of the present invention is advantageous in more increasing the amount of toner filled in the cartridge without changing the volume of cartridge or downsizing the cartridge.

Furthermore, the toner of the present invention was excellent in the storability, durability and transfer efficiency.

On the other hand, the toner of Comparative Examples is varied widely in the electric charge and small in the bulk density. Furthermore, the toner of Comparative Examples was inferior in the storability, durability and transfer efficiency.

Incidentally, in the case of using a spray dry method, even when various conditions such as gas jetting pressure and raw material temperature are set to suitable values, the circularity of the obtained toner particle is usually about 0.97, the standard deviation of circularity is about 0.04 and the standard deviation of particle size is about 2.7 μm.

As illustrated above, according to the present invention, a toner having a uniform shape and small in the width of particle size distribution can be provided.

These effects can be more enhanced by adjusting various conditions such as the composition of the dispersion, the frequency of the piezoelectric body, the frequency of alternating voltage applied to the heating element, the opening diameter of the ejection portion, the temperature and viscosity of the dispersion, the content of the dispersoid in the dispersion and the average particle size of the dispersoid.

While the invention has been described in detail and with reference to specific embodiments thereof, it will be apparent to one skilled in the art that various changes and modifications can be made therein without departing from the spirit and scope thereof.

The present application is based on Japanese Patent Application Nos. 2002-169348 and 2002-169349 both filed Jun. 10, 2002, the contents thereof being incorporated herein by reference.

What is claimed is:

1. A method for producing a toner, which produces a toner by using a dispersion comprising a dispersion medium having finely dispersed therein a dispersoid containing a raw material for the production of a toner, said method comprising intermittently ejecting said dispersion from a head unit by applying an ejection energy and solidifying it into a particulate form while transporting the ejected dispersion through a solidification unit by an air flow.

2. The method for producing a toner according to claim 1, wherein said ejection energy is applied in the form of pressure pulse.

3. The method of producing a toner according to claim 1, wherein said ejection energy is applied by a volume change of a bubble.

4. The method for producing a toner according to claim 3, wherein said volume change of a bubble mainly accompanies a liquid/gas phase transition of said dispersion medium.

5. The method for producing a toner according to any one of claims 1 to 3, wherein said dispersoid in said dispersion ejected from said head unit is aggregated during the passing through the solidification unit.

6. The method for producing a toner according to any one of claims 1 to 3, wherein said dispersoid is a liquid.

7. The method for producing a toner according to any one of claims 1 to 3, wherein said dispersion medium mainly comprises water and/or a liquid having excellent compatibility with water.

8. The method for producing a toner according to any one of claims 1 to 3, wherein said dispersion contains an emulsifying dispersant.

9. The method for producing a toner according to any one of claims 1 to 3, wherein said dispersion is an O/W emulsion.

10. The method for producing a toner according to any one of claims 1 to 3, wherein said dispersion is prepared by charging a material containing a resin or a precursor thereof into a liquid containing at least water.

11. The method for producing a toner according to claim 10, said material to be charged is in the state of at least a part thereof being softened or melted.

12. The method for producing a toner according to claim 10, wherein said material is in the powder or particulate form.

13. The method for producing a toner according to any one of claims 1 to 3, wherein said dispersion is prepared through a mixing step of mixing a resin solution containing at least a resin or a precursor thereof and a solvent capable of dissolving at least a part of said resin or precursor with an aqueous solution containing at least water.

14. The method for producing a toner according to claim 13, wherein said mixing step is carried out by adding dropwise a liquid droplet of said resin solution to said aqueous solution.

15. The method for producing a toner according to claim 13, wherein the mixed solution obtained in said mixing step is used as it is as said dispersion substantially without removing said solvent from said mixed solution, and said solvent is removed during the passing of said dispersion through said solidification unit.

16. The method for producing a toner according to claim 13, wherein said dispersion is prepared by removing at least a part of said solvent after said mixing step.

17. The method for producing a toner according to claim 13, wherein said solvent is removed by heating.

18. The method for producing a toner according to any one of claims 1 to 3, wherein said dispersoid in said dispersion has an average particle size of from 0.05 to 1.0 μm.

19. The method for producing a toner according to any one of claims 1 to 3, wherein when the average particle size of said dispersoid in said dispersion is designated as Dm (μm) and the average particle size of the toner particle produced is designated as Dt (μm), these average particle sizes satisfy the relationship of $0.005 \leqq Dm/Dt \leqq 0.5$.

20. The method for producing a toner according to any one of claims 1 to 3, wherein said dispersion has a content of said dispersoid of from 1 to 99 wt %.

21. The method for producing a toner according to any one of claims 1 to 3, wherein the ejection amount in one droplet portion of said dispersion ejected from said head unit is from 0.05 to 500 pl.

22. The method for producing a toner according to any one of claims 1 to 3, wherein when the average particle size of said dispersion ejected from said head unit is designated as Dd (μm) and the average particle size of said dispersoid in said dispersion is designated as Dm (μm), these average particle sizes satisfy the relationship of $Dm/Dd \leqq 0.5$.

23. The method for producing a toner according to any one of claims 1 to 3, wherein when the average particle size of said dispersion ejected from said head unit is designated as Dd (μm) and the average particle size of the toner particle produced is designated as Dt (μm), these average particle sizes satisfy the relationship of $0.05 \leqq Dt/Dd \leqq 1.0$.

24. The method for producing a toner according to claim 2, wherein said head unit has a dispersion storing section of storing said dispersion, a piezoelectric body of applying a pressure pulse to said dispersion stored in said dispersion storing section, and an ejection portion of ejecting said dispersion by said pressure pulse.

25. The method for producing a toner according to claim 24, wherein said ejection portion has a substantially circular shape and the diameter thereof is from 5 to 500 μm.

26. The method for producing a toner according to claim 2, wherein said pressure pulse for ejecting said dispersion from said head unit is converged by an acoustic lens.

27. The method for producing a toner according to claim 24, wherein the frequency of said piezoelectric body is from 10 kHz to 500 MHz.

28. The method for producing a toner according to claim 2, further comprising applying heat to said dispersion to be ejected from said head unit.

29. The method for producing a toner according to claim 3, wherein said head unit has a dispersion storing section of storing said dispersion, a heating element of giving a heat energy to said dispersion stored in said dispersion storing section to generate a bubble in said dispersion storing section, and an ejection portion of ejecting said dispersion by utilizing the change in volume of said bubble.

30. The method for producing a toner according to claim 29, wherein said ejection portion has a substantially circular shape and the diameter thereof is from 5 to 500 μm.

31. The method for producing a toner according to claim 29, wherein said heat energy is generated by applying an alternating voltage to said heating element.

32. The method for producing a toner according to claim 31, wherein the alternating voltage applied to said heating element has a frequency of from 1 to 50 kHz.

33. The method for producing a toner according to any one of claims 1 to 3, wherein said dispersion ejected from said head unit is released into a gas stream flowing substantially in one direction.

34. The method for producing a toner according to any one of claims 1 to 3, wherein said dispersion is ejected from a plurality of said head units.

35. The method for producing a toner according to claim 34, wherein said dispersion is ejected while jetting out a gas from spaces between each adjacent head units of said plural head units.

36. The method for producing a toner according to claim 35, wherein said gas to be jetted out from the spaces has a humidity of 50% RH or less.

37. The method for producing a toner according to claim 34, wherein the timing of ejecting said dispersion is differentiated at least between each two adjacent head units of said plural head units.

38. The method for producing a toner according to any one of claims 1 to 3, wherein said dispersion is ejected into said solidification unit while applying a voltage having the same polarity with said dispersion.

39. The method for producing a toner according to any one of claims 1 to 3, wherein said dispersion is ejected from said head unit so as to have an initial ejection speed of from 0.1 to 10 m/sec.

40. The method for producing a toner according to any one of claims 1 to 3, wherein said dispersion in said head unit has a viscosity of from 5 to 3,000 cps.

41. The method for producing a toner according to any one of claims 1 to 3, wherein said dispersion medium is removed in said solidification unit.

42. The method for producing a toner according to any one of claims 1 to 3, wherein said solidification unit has an inner pressure of 0.15 MPa or less.

43. The method for producing a toner according to any one of claims 1 to 3, wherein at least a part of component(s) of said dispersoid in said dispersion is dissolved in a solvent.

44. The method for producing a toner according to claim 43, wherein at least a part of said solvent contained in said dispersoid is removed in said solidification unit.

45. The method for producing a toner according to any one of claims 1 to 3, wherein said dispersion ejected from said head unit is in the state of at least a part of said dispersoid being softened or melted.

46. The method for producing a toner according to any one of claims 1 to 3, further comprising cooling said dispersion ejected from said head unit in said solidification unit.

47. The method for producing a toner according to any one of claims 1 to 3, further comprising heating said dispersion ejected from said head unit in said solidification unit.

* * * * *